US007008201B2

(12) United States Patent
Heizer

(10) Patent No.: US 7,008,201 B2
(45) Date of Patent: Mar. 7, 2006

(54) GAPLESS SCREW ROTOR DEVICE

(75) Inventor: Charles K. Heizer, St. Louis, MO (US)

(73) Assignee: Imperial Research LLC, Pevely, MO (US)

( * ) Notice: Subject to any disclaimer, the term of this patent is extended or adjusted under 35 U.S.C. 154(b) by 74 days.

(21) Appl. No.: 10/810,513

(22) Filed: Mar. 27, 2004

(65) Prior Publication Data

US 2005/0129561 A1 Jun. 16, 2005

Related U.S. Application Data

(63) Continuation-in-part of application No. 10/283,421, filed on Oct. 29, 2002, now Pat. No. 6,719,547, which is a continuation-in-part of application No. 10/013,747, filed on Oct. 19, 2001, now Pat. No. 6,599,112.

(51) Int. Cl.
*F01C 1/16* (2006.01)

(52) U.S. Cl. ..... 418/201.1; 418/104; 418/142

(58) Field of Classification Search ..... 418/201.1, 418/201.3, 104, 142, 166, 171
See application file for complete search history.

(56) References Cited

U.S. PATENT DOCUMENTS

| | | | |
|---|---|---|---|
| 726,969 | A | 5/1903 | Motsinger |
| 1,698,802 | A | 1/1929 | Montelius |
| 2,174,522 | A | 10/1939 | Lysholm |
| 2,321,696 | A | 6/1943 | Montelius |
| 2,473,234 | A | 6/1949 | Whitfield |
| 2,486,770 | A | 11/1949 | Whitfield |
| 2,511,878 | A | 6/1950 | Rathman |
| 2,622,787 | A | 12/1952 | Nilsson |
| 3,245,612 | A | 4/1966 | H.R. Nilsson et al. |
| 3,282,495 | A * | 11/1966 | Walls ..... 418/201.1 |

(Continued)

FOREIGN PATENT DOCUMENTS

DE 4121 A * 3/1878

(Continued)

OTHER PUBLICATIONS www.matteicomp.com/about/screwcompressors/page1.htm, dated Mar. 24, 2004 Mattei Compressors, Inc. IN-DEPTH p. 7.

(Continued)

*Primary Examiner*—Theresa Trieu
(74) *Attorney, Agent, or Firm*—Dennis JM Donahue, III; Husch & Eppenberger LLC

(57) ABSTRACT

A screw rotor device has a housing with an inlet port and an outlet port, a male rotor with helical threads, and a female rotor with helical grooves. The helical threads and helical grooves are designed to eliminate the blow hole leak pathway for multiple-pitch screw rotor devices as well as single-pitch screw rotor devices. The male rotor has a pair of helical threads with a phase-offset aspect, and the female rotor has a corresponding pair of helical grooves. The female rotor counter-rotates with respect to the male rotor and each of the helical grooves respectively intermeshes in phase with each of the helical threads. The phase-offset aspect of the helical threads is formed by a pair of teeth bounding a toothless sector.

104 Claims, 17 Drawing Sheets

U.S. PATENT DOCUMENTS

| | | | | |
|---|---|---|---|---|
| 3,693,601 | A | 9/1972 | Sauder | |
| 3,814,557 | A | 6/1974 | Volz | |
| 4,445,831 | A | 5/1984 | Ingalls | |
| 4,781,553 | A * | 11/1988 | Nomura et al. | 418/201.1 |
| 5,533,887 | A * | 7/1996 | Maruyama et al. | 418/201.3 |
| 5,554,020 | A * | 9/1996 | Rao et al. | 418/178 |
| 5,800,151 | A | 9/1998 | Kawamura et al. | |
| 6,244,844 | B1 | 6/2001 | Diaz | |
| 6,612,820 | B1 * | 9/2003 | Staat et al. | 418/201.1 |
| 2003/0178012 | A1 | 9/2003 | Gielda et al. | |

FOREIGN PATENT DOCUMENTS

| | | | |
|---|---|---|---|
| DE | 7116 | A * | 8/1878 |

OTHER PUBLICATIONS

A New Rotary Compressor, by A.J.R. Lysholm, M.I. Mech.E.; pp 11-21.

* cited by examiner

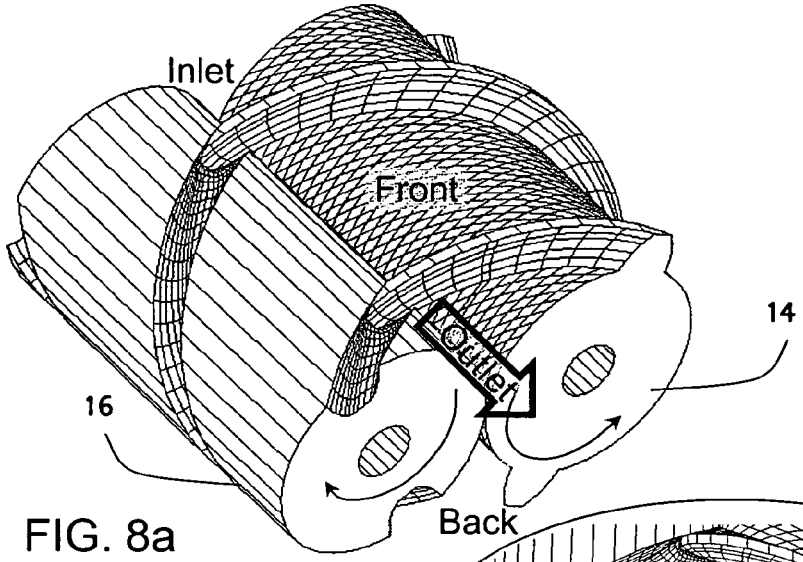
FIG. 8a
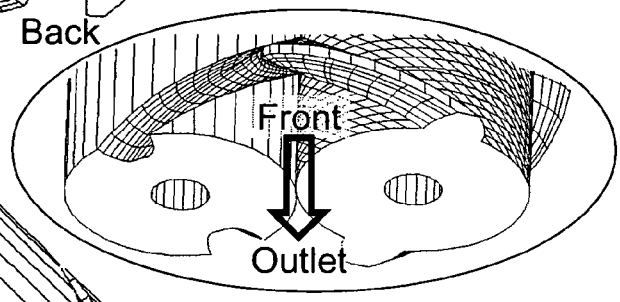
FIG. 8b
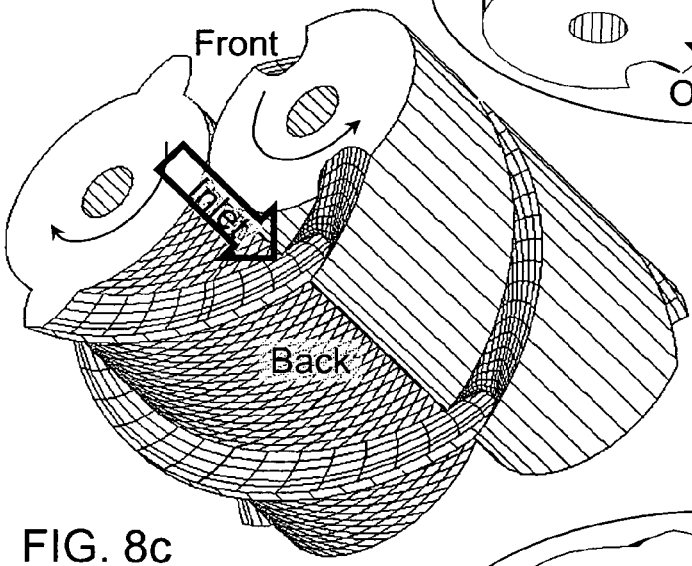
FIG. 8c
FIG. 8d
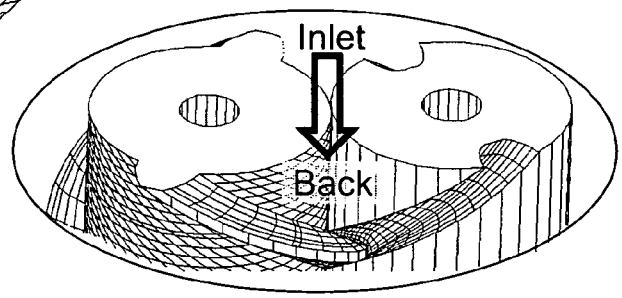

GAPLESS SCREW ROTOR DEVICE

CROSS-REFERENCE TO RELATED APPLICATIONS

This application is a continuation-in-part of U.S. application Ser. No. 10/283,421, filed on Oct. 29, 2002 and issued as U.S. Pat. No. 6,719,547 on Apr. 13, 2004, which is a continuation-in-part of U.S. application Ser. No. 10/013,747, filed on Oct. 19, 2001 and issued as U.S. Pat. No. 6,599,112 on Jul. 29, 2003.

This application is also related to the subject matter in co-pending U.S. Application Ser. No. 10/283,422, filed on Oct. 29, 2002 and issued as U.S. Pat. No. 6,719,548 on Apr. 13, 2004, which is hereby incorporated by reference into the present invention disclosure. This application is also related to the subject matter in co-pending U.S. application Ser. No. 10/764,195, patent application filed on Jan. 23, 2004, which is also a continuation of U.S. application Ser. No. 10/283,421 and is also hereby incorporated by reference into the present invention disclosure.

STATEMENT REGARDING FEDERALLY SPONSORED RESEARCH OR DEVELOPMENT

Not Applicable.

BACKGROUND OF THE INVENTION

1. Field of the Invention

This invention relates generally to rotor devices and, more particularly to screw rotors.

2. Description of Related Art

Screw rotors are generally known to be used in compressors, expanders, and pumps. For each of these applications, a pair of screw rotors have helical threads and grooves that intermesh with each other in a housing. For an expander, a pressurized gaseous working fluid enters the rotors, expands into the volume as work is taken out from at least one of the rotors, and is discharged at a lower pressure. For a compressor, work is put into at least one of the rotors to compress the gaseous working fluid. Similarly, for a pump, work is put into at least one of the rotors to pump the liquid. The working fluid, either gas or liquid, enters through an inlet in the housing, is positively displaced within the housing as the rotors counter-rotate, and exits through an outlet in the housing.

The rotor profiles define sealing surfaces between the rotors themselves between the rotors and the housing, thereby sealing a volume for the working fluid in the housing. The profiles are traditionally designed to reduce leakage between the sealing surfaces, and special attention is given to the interface between the rotors where the threads and grooves of one rotor respectively intermesh with the grooves and threads of the other rotor. The meshing interface between rotors must be designed such that the threads do not lock-up in the grooves, and this has typically resulted in profile designs similar to gears, having radially widening grooves and tightly spaced involute threads around the circumference of the rotors. However, an involute for a gear tooth is primarily designed for strength and to prevent lock-up as teeth mesh with each other and are not necessarily optimum for the circumferential sealing of rotors within a housing.

The performance characteristics of screw rotors depend on several factors, including thermodynamic efficiencies, volumetric efficiencies, and mechanical efficiencies. Adiabatic efficiency is one type of parameter to evaluate the thermodynamic efficiency of a screw rotor system. Adiabatic efficiency is the ratio of the adiabatic horsepower required to compress a given amount of gas to the actual horsepower expended in the compressor cylinder. Volumetric efficiency is the ratio of the actual volume of working fluid flowing through the screw rotor, such as in one complete revolution, to the geometric volume of the screw rotor measured, which is also measured for one complete revolution. Mechanical efficiencies can include the efficiencies of any gear train that may be used to keep the rotors in proper phase with each other, bearings, and seals.

Although adiabatic efficiency and volumetric efficiency are different performance parameters, a number of screw rotor features can affect both of these efficiencies. For example, tightening tolerances between the rotors and the housing can improve both the volumetric efficiency and the adiabatic efficiency of a given rotor design. However, if tolerances are too tight for a given design, the volumetric efficiency may be improved while the adiabatic efficiency drops. Such performance characteristic could be caused by thermal expansion of the rotors, machining tolerances, and even the material properties of the rotors, which can result in intermittent contact between the rotors and the sides of the housing or between the rotors themselves.

Generally, one of the best ways to improve thermodynamic efficiencies is by keeping tight tolerances and minimizing leak pathways between the rotors and the housing and between the rotors themselves. However, in prior art screw rotors, leak pathways are inherent in the actual design of the rotors, i.e., the leaks can be reduced but not eliminated. Such inherent leaks would occur even when the tolerances are perfected, i.e., zero thermal expansion, perfect machining tolerances, and a perfectly smooth finished material. These leak pathways result in losses that adversely affect both the thermodynamic efficiency and the volumetric efficiency of screw rotors.

Accordingly, leak pathways are some of the most important losses to consider for the performance of screw rotors when the screw rotors are being designed because these losses negatively affect both thermodynamic efficiency and volumetric efficiency. Even with this knowledge that leak pathways should be minimized, the design methodology used for screw rotors produces these pathways as an inherent aspect of traditional screw rotor profiles. In fact, it is a common belief by the designers, manufacturers and users of screw rotors that it is impossible to eliminate some of the leaks in a screw rotor system. For example, according to Mattai Compressors, Inc., at its web site www.matteicomp.com/About/ScrewCompressors/, this belief is concisely stated even as this application is being filed in March 2004: "The technical problem is typical of the geometry of screw compressors. All screw manufacturers have tried to reduce the effect of the 'blow hole' by analyzing and adapting new rotor profiles to create smaller openings at the critical point, but its complete elimination is impossible." Accordingly, to minimize the leak pathways, it is common knowledge that the rotors should seal perfectly along the contact line, but a number of prior art references also teach that the contact line should be as short as possible, i.e., should not extend to cusps on opposite sides of the housing. Several embodiments of short contact lines are set forth in the applicant's patent application Ser. No. 10/283,421 (Pub. No. 2003/0077198) and U.S. application Ser. No. 10/283,422. However, there remains a need for better methodologies for designing screw rotor profiles that account for machining constraints, thermal expansion and material tolerances, as well as mechanical efficiencies, and that also eliminate any inherent leak pathway from the design process, even though it is presently considered impossible. One example of a machining constraint set forth in the prior art is the need for blunt edges because of the concern that sharp edges have a tendency to break, e.g., U.S. Pat. No. 2,486,770.

Once the leak pathway problem is eliminated from the design methodology, i.e., screw rotor profiles that do inherently produce a leak pathway, the designer can balance all of the rotors' performance characteristics. For example, a rotor design without any inherent leak pathway may be slightly changed to include a small gap or leak pathway to permit another aspect to improve the rotors' overall performance at a given design point, i.e., tighter tolerances at steady state operation with thermal expansion. In comparison, when the leak pathway remains an inherent feature of the rotor profiles, the designer must first minimize the leak pathway using more complex designs that are harder and costlier to manufacture and then changes to the design are limited by the complexity of the design, machining and other manufacturing capabilities and thermal expansion requirements. Therefore, a new design methodology that produces screw rotor profile shapes without any leak pathways is needed. Additionally, it would also be advantageous if sharp-edged shapes that eliminate leak pathways and do not have a tendency to break could be designed and manufactured.

Leak pathways are generally caused by internal leakage between the rotors and the housing and between the rotors themselves and result in volumetric losses and thermodynamic losses due to recirculation of the working fluid within the rotors. For example, working fluid that is pressurized and leaks into a lower pressure region of the rotors is caused to expand to the lower pressure state with a higher temperature due to entropy and then must recirculate through the rotors before being expelled. Therefore, the overall temperature of entire rotor system, including the rotors and the working fluid, is increased due to the gain in entropy. Internal leakage is detected specifically at the following points:

(1) gaps between the inlet port and/or outlet port in the housing and the rotors, resulting in less than complete capture or ejection of the working fluid through the rotors;

(2) gaps between the outer periphery of each rotor and the inner surface of the housing, through which the working fluid leaks around the top land of a thread or the ridge of a groove to an adjacent working volume, respectively;

(3) gaps between the front and back of the intermeshing male rotor thread and female rotor groove, through which the working fluid leaks from the pressurized side to the suction side; and (4) a gap formed on the front side of the rotor in the transition region, where the male rotor threads intermesh with the female rotor grooves proximate to the cusp of the cylindrical bores and which generally forms a tetrahedron (or a triangular shape in two-dimensions) that is defined by the shape of the gap between the intermeshing thread and groove and the cusp, and another gap similarly formed on the back side of the rotor, through which the working fluid leaks from one V-shaped working volume to an adjacent V-shaped working volume, i.e. commonly referred to as a blow hole, and through which the working fluid leaks from a pressurized region to a less pressurized region or to a suction region.

As discussed above, threads must provide seals between the rotors and the walls of the housing and between the rotors themselves, and in all designs before the present invention, there has been a transition from sealing around the circumference of the housing to sealing between the rotors. In this transition, a gap is formed between the meshing threads and the housing, causing leaks of the working fluid through the gap in the sealing surfaces and resulting in less efficiency in the rotor system. A number of arcuate profile designs improve the seal between rotors and may reduce the gap in this transition region but these profiles still retain the characteristic gear profile with tightly spaced teeth around the circumference, resulting in a number of gaps in the transition region that are respectively produced by each of the threads. Some pumps minimize the number of threads and grooves and may only have a single acme thread for each of the rotors, but these threads have a wide profile around the circumferences of the rotors and generally result in larger gaps in the transition region.

Until now, screw rotor expanders, compressors and pumps have had similar fundamental flaws. Generally, they allow for leak pathways between the working side, i.e., expansion, compression or pumping, to the side that should be sealed from the working side for proper operation of the rotors, i.e., non-working. These rotor designs are commonly referred to as Roots-type rotors and Lysholm-type rotors. Krigar-type rotors, which are described in German Patent Nos. DE 4121 and DE 7116 from more than a century ago, have fallen out of favor, and this may possibly be due to the rise of the Lysholm-type rotors in the 1930's and 1940's. In an article entitled "A New Rotary Compressor" and written by Lysholm in the 1940's, Lysholm puts down the Krigar design as being unable to obtain any compression between the lobes with a two-thread/two-groove design (2×2 configuration). While it is clear from the images of the Krigar design that there definitely were sealing issues, especially between the threads and the grooves, and Krigar appears to be more directed to radial flow, the Lysholm conclusion that the Krigar design could not perform any compression with only the 2×2 configuration is flawed. Regardless, the industry and teachings have generally followed Lysholm and Roots with very little interest given to Krigar, except as a historical reference.

Based primarily on the Lysholm concept, many screw rotor designs have attempted to seal the male rotor with the female rotor and the housing, but the prior art designs have either a leak pathway between the rotors themselves or a leak pathway between the rotors and the housing, i.e., which according to the prior art quoted above, the elimination of which is "impossible." In the past, the design of screw rotors have been based on profile designs that do not necessarily follow a mathematical formula, i.e., empirical design methodology, while other designs are based on particular curves or a combination of piecewise curves, i.e., formula design methodology, such as lines, arcs, circles, squares, trapezoids, involutes, inverse-involutes, parabolas, hyperbolas, cycloids, trochoids, epicycloids, epitrochoids, hypocycloids, hypotrochoids, as well as other straight and arcuate lines, and still other designs combine formula and empirical design methodologies. However, regardless of the design methodology, empirical or formula or a combination thereof, prior designs and respective methods for creating rotor profiles either explicitly teach or implicitly suggest and disclose creating the profile for the thread and corresponding groove using the shortest seal path between the rotors, i.e. the sealing region does not extend from the front cusp all the way to the back cusp. Additionally, many of the prior art methods are based on and remain similar to traditional gear design methods.

Some earlier designs have come close to a complete seal or may even be able to effect a complete seal in one pitch, see in particular co-pending U.S. application Ser. No. 10/283,422. Even for these single-pitch sealing rotors, some of the seals may only be along sealing lines, rather than sealing areas. Additionally, since the rotor profiles are designed according to the traditional gear profile design methods, these rotors are usually limited in the types of arcuate lines that can be used to effect the seal. Without accounting for the third dimension, the arcuate lines have typically been limited to epitrochoids, epicycloids, hypocycloids and other types of spirals, such as an Archimedean spiral.

When the third dimension is accounted for in prior art design methodologies, it is typically limited to standard helix angle definitions that have been developed for ordinary screws, i.e., fastening screws. Such an approach fails to truly account for and does not take advantage of the third dimension. It is well known that for any screw rotor, the helix angle of the grooves and threads vary depending on their depth. In particular, the top land of the thread has a lesser helix angle than the root of the thread, and the trough of the groove has a greater helix angle than the ridge of the groove. Accordingly, merely using a single helix angle for a rotor, such as the top land, the root, or any other single angle, even with a correction factor, has not accounted for the variations in the helix angles of the thread and the groove. In this way, the known screw rotor geometries are created using planar design methodologies for the rotor profiles rather than using a volumetric design methodology.

The planar design methodologies fail to apply the function of the helix angle with respect to the radius, resulting in the profiles with leak pathways discussed above. In one aspect, the planar design methods are unnecessarily restrictive because they only take advantage of two-dimensional space to overcome the limitation that the threads must not lock-up in the grooves. In another aspect, the planar design methods are not restrictive enough because when the profiles are expanded into three-dimensional space, the profiles have three-dimensional leak pathways. The extra degree of freedom provided by the third-dimension allows for a volumetric design that prevents lock-up while permitting perfect sealing between the male rotor and female rotor and between the rotors and the housing, a perfect seal which is equivalent to the complete seal of pistons. More generally, similar fundamental flaws in the prior art designs and their respective methodologies can be traced back to their failure to accommodate for and use the additional degree of design freedom provided by the third dimension. It is the additional degree of design freedom of volumetric design methodologies that permits an unlimited number of profile designs which effect a complete seal without locking up the rotors and without the unnecessary restrictions of the planar design methodologies.

For many prior art rotors, the leak pathway can be found between the face of the thread and the housing. In particular, the thread and groove are designed with significant curvatures at their top land edges and ridges according to the standard manner of designing meshing gear teeth. Such rounded edges and ridges cannot possibly seal between the rotors and the housing when the thread and groove begin meshing with each other. As the thread and groove rotate away from their seals with the housing and into their meshing positions with each other, the rounded edges produce a gap between the housing and the groove and/or the thread before the groove and thread actually mesh and reform a sealing line. The gap between the housing to groove and thread seal can be an order of magnitude greater than the tolerances for the seals between the between the rotors and the housing and the rotors themselves. In some designs, the gap can be even larger, such as in screw rotors that have a different number of threads and grooves, i.e. not the same number of threads as grooves, and the loss in pressure to the low pressure side causes the thermodynamic efficiency to drop. Therefore, the rotors must work harder to pump the same volume of air as compared with rotors according to the present invention which can maintain the same order of magnitude in the seal tolerances when each thread and respective groove begin meshing with each other as compared to the seal between the rotors and the housing and the rotors when in their fully intermeshed positions.

Additionally, by failing to take advantage of the third dimension in the design of the thread and groove, the prior art design methods have failed to optimize the basic screw rotor design or improve the screw rotor efficiencies to their full potential. As discussed above, the prior art design methodologies generally use planar coordinates to define the thread and groove profiles, and the third dimension is merely considered for the helix angle of the profiles. In an attempt to compensate for this unwitting failure to take advantage of the third dimension, the prior art designs have increasingly become more complex over the years without offering much improvement in the thermodynamic efficiency of the rotor system. As evidence of the failure to appreciate volumetric design methodologies as an alternative to traditional gear design methods combined with traditional fastener screw methods, these planar design methodologies increasingly led to these more complex screw rotor designs as machining and other manufacturing methods improved over the years and permitted the increasing complexity. Additionally, these increasingly complex screw rotor profile designs, which need such improved manufacturing methods, support the conclusion that the failure to take advantage of the third dimension has been an unwitting failure because volumetric design methodologies actually permit much more simplified designs which can be less complex to manufacture than profiles created using the planar design methodologies.

BRIEF SUMMARY OF THE INVENTION

Generally, the present invention provides a design methodology for generating thread and groove profiles which take advantage of the three-dimensional geometry of intermeshing rotors. In particular, the present invention has generally solved the problem of leak pathways that have plagued screw rotor designs for over one hundred years. The present invention provides a design methodology that is based on the fundamental premise that the helix angles of screw rotors vary with respect to each other as their threads join and then separate with the grooves and that to eliminate the blow-hole, the sealing region must extend completely from the housing's front cusp to its back cusp. Accordingly, each screw rotor embodiment of the present invention can eliminate at least one blow-hole gap, the front side, the back side or both, and this is is the first screw rotor device that eliminates the blow hole gap while also maintaining the seal between the thread and the groove regardless of the number of pitches.

It is an advantage of the present invention to maximize the thermodynamic efficiency and the volumetric efficiency in a screw rotor system by several means, such as reducing gaps, minimizing recirculation within the screw rotor housing, reducing shock waves within the screw rotors, reducing entropy, and reducing sliding friction between the male rotor and the female rotor. It is also an advantage of the present invention that it is readily producible. The designs can be rather simple and still maintain a good sealing relationship. Therefore, the present invention does not suffer from an overly complicated design that is difficult to machine or to otherwise manufacture. It is another advantage of the present invention that it can reduces and nearly eliminate backlash. It is yet another advantage of the present invention that it can reduce the cost of manufacturing screw rotor compressors and, due to its increased thermodynamic and volumetric efficiencies, it can also reduce the cost of ownership for screw rotor compressors. It is a further advantage that the present invention provides economy, efficiency and speed of assembly in manufacturing, and also reduces the cost of component assembly and the packaging costs of the product. It is yet a further advantage of the present invention in that the screw rotor system can be designed as a modular device that can be replaced with a cartridge-type system or completely integrated into a particular product. To the extent that various components of the screw rotor system are manufactured separately, and then shipped to an assembler for fixation of additional components &/or for further assembly into final products, the modular aspects of the present invention improve the efficiency and economy of assembly. In comparison to bladed compressors and turbines, the present invention is much stronger, more economical, and provides more compact components.

Accordingly, no earlier design follows the design methodology of the present invention which, as discussed below, can effect a compete seal regardless of the types of lines, straight or arcuate. The present invention can also effect a complete seal for multiple pitched rotors. The new design method is even so robust that it produces geometries that can even effect a complete seal multiple areas simultaneously, including areas between the male rotor and the female rotor as well as between the rotors and the housing.

Now that this design problem has been identified, it will be appreciated that by viewing the threads and grooves in the third dimension and making accommodations for the third dimension in the design process, there is an additional degree of design freedom which permits intermeshing screw rotors to be designed without leak pathways or other gaps between the male rotor and the female rotor and between the rotors and the housing, including the blow-hole at the transition region and discussed above. Once the design problem is viewed in the third dimension, it becomes clear that there should be a way to eliminate the blow-hole gap while maintaining the seals between the thread and groove. Accordingly, the present invention teaches that, to eliminate the blow-hole gap, the sealing region should extend completely from the housing's front cusp to its back cusp. Finally, when the design choices are again translated into planar design methodology, the creation of the designs becomes much less difficult than many of the planar design methodologies that are increasingly being suggested as the only way to increase the efficiencies.

Also disclosed herein is an example of the inventive method for designing entire families of the present invention's threads and corresponding grooves. The new thread and groove design results in a high-efficiency screw rotor system which is heretofore unknown in the prior art. The features of the invention result in an advantage of improved thermodynamic efficiency and improved volumetric efficiency of the screw rotor device. Tests on the prototype design show that the thermodynamic efficiency are likely to reach greater than 85% and may even exceed 90%. The present invention is seminal because it is the first screw rotor to achieve these efficiencies over a wide range of rotor speeds.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIGS. 8A–8D illustrate perspective views of another embodiment of the screw rotor device according to the present invention.

DETAILED DESCRIPTION OF THE INVENTION

Figure 1:
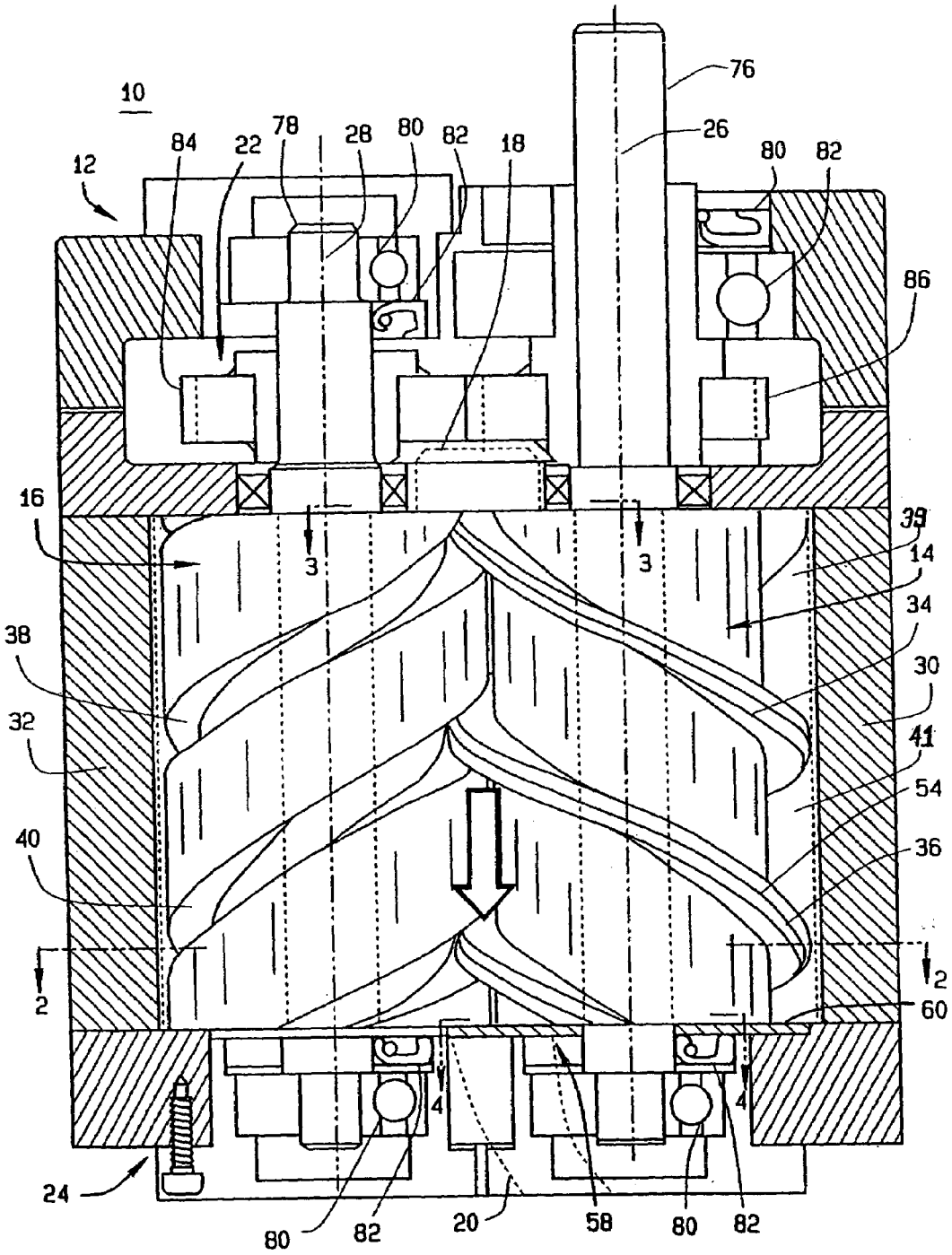
FIG. 1 illustrates an axial cross-sectional view of a screw rotor device according to the present invention.
Figure 9:
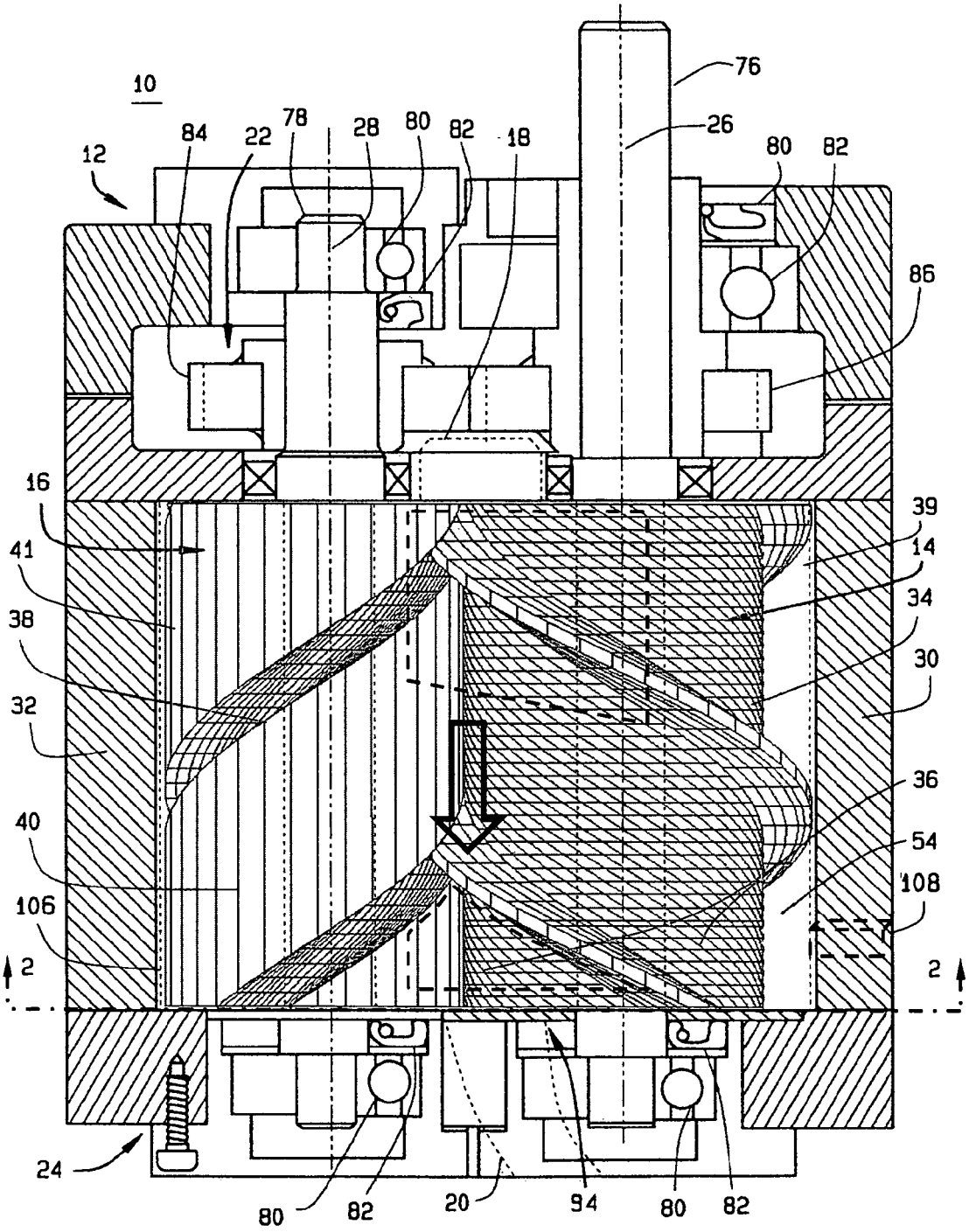
FIG. 9 illustrates an axial cross-sectional view of the screw rotor device according to the embodiment of the invention in FIGS. 8A–8D.

Referring to the accompanying drawings in which like reference numbers indicate like elements, FIGS. 1 and 9 illustrate an axial cross-sectional schematic view of a screw rotor device 10. The screw rotor device 10 generally includes a housing 12, a male rotor 14, and a female rotor 16. The housing 12 has an inlet port 18 and an outlet port 20. The inlet port 18 is preferably located at the gearing end 22 of the housing 12, and the outlet port 20 is located at the opposite end 24 of the housing 12. The male rotor 14 and female rotor 16 respectively rotate about a pair of substantially parallel axes 26, 28 within a pair of cylindrical bores 30, 32 extending between ends 22, 24.

In the preferred embodiment, the male rotor 14 has at least one pair of helical threads 34, 36, and the female rotor 16 has a corresponding pair of helical grooves 38, 40. The female rotor 16 counter-rotates with respect to the male rotor 14 and each of the helical grooves 38, 40 respectively intermeshes in phase with each of the helical threads 34, 36. In this manner, the working fluid flows through the inlet port 18 and into the screw rotor device 10 in the spaces 39, 41 bounded by each of the helical threads 34, 36, the female rotor 16, and the cylindrical bore 30 around the male rotor 14. It will be appreciated that the helical grooves 38, 40 also define spaces bounding the working fluid. The spaces 39, 41 are closed off from the inlet port 18 as the helical threads 34, 36 and helical grooves 38, 40 intermesh at the inlet port 18. As the female rotor 16 and the male rotor 14 continue to counter-rotate, the working fluid is positively displaced toward the outlet port 20.

Figure 2A:
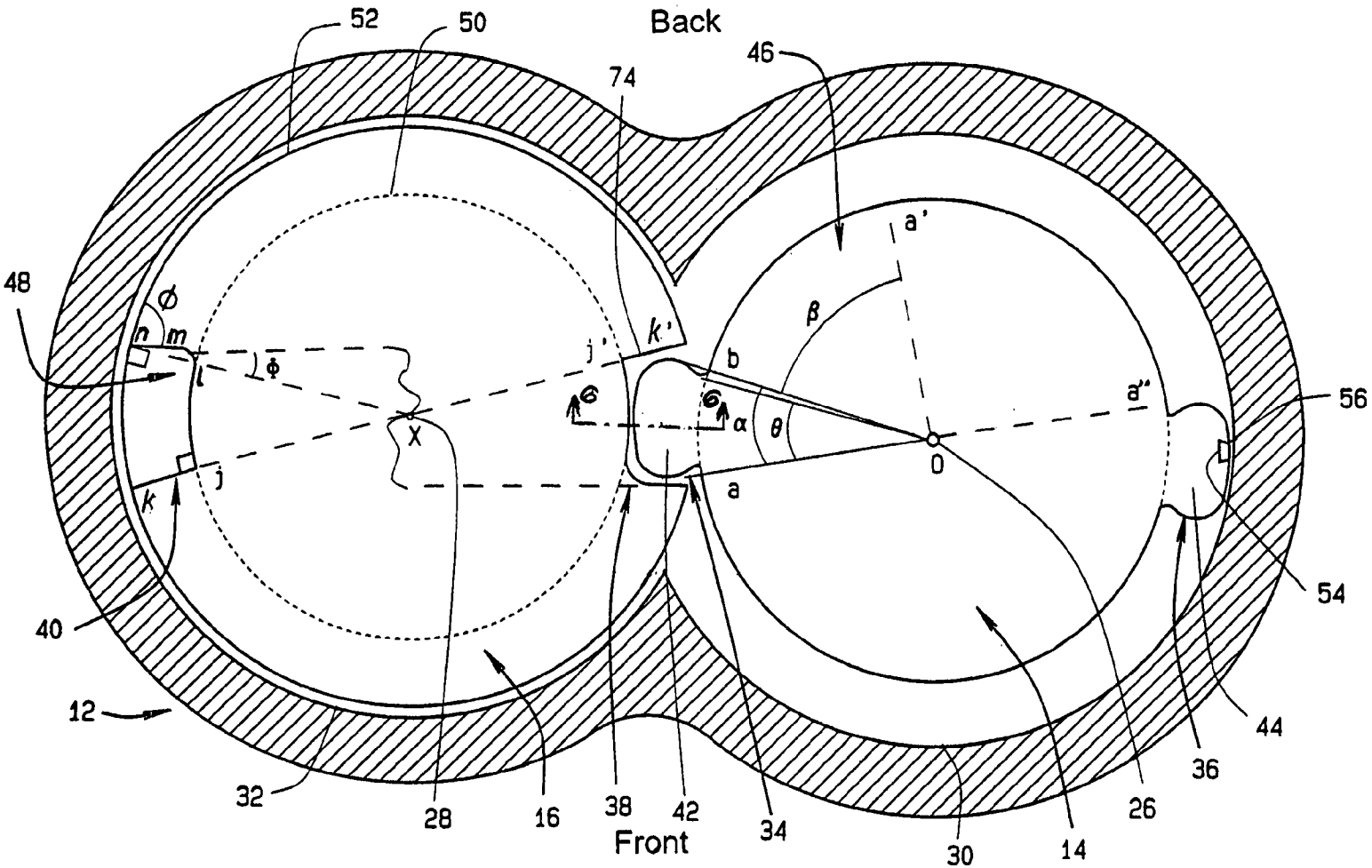
FIG. 2A illustrates a detailed cross-sectional view of one embodiment of the screw rotor device taken along the line 2—2 of FIG. 1.
Figure 2B:
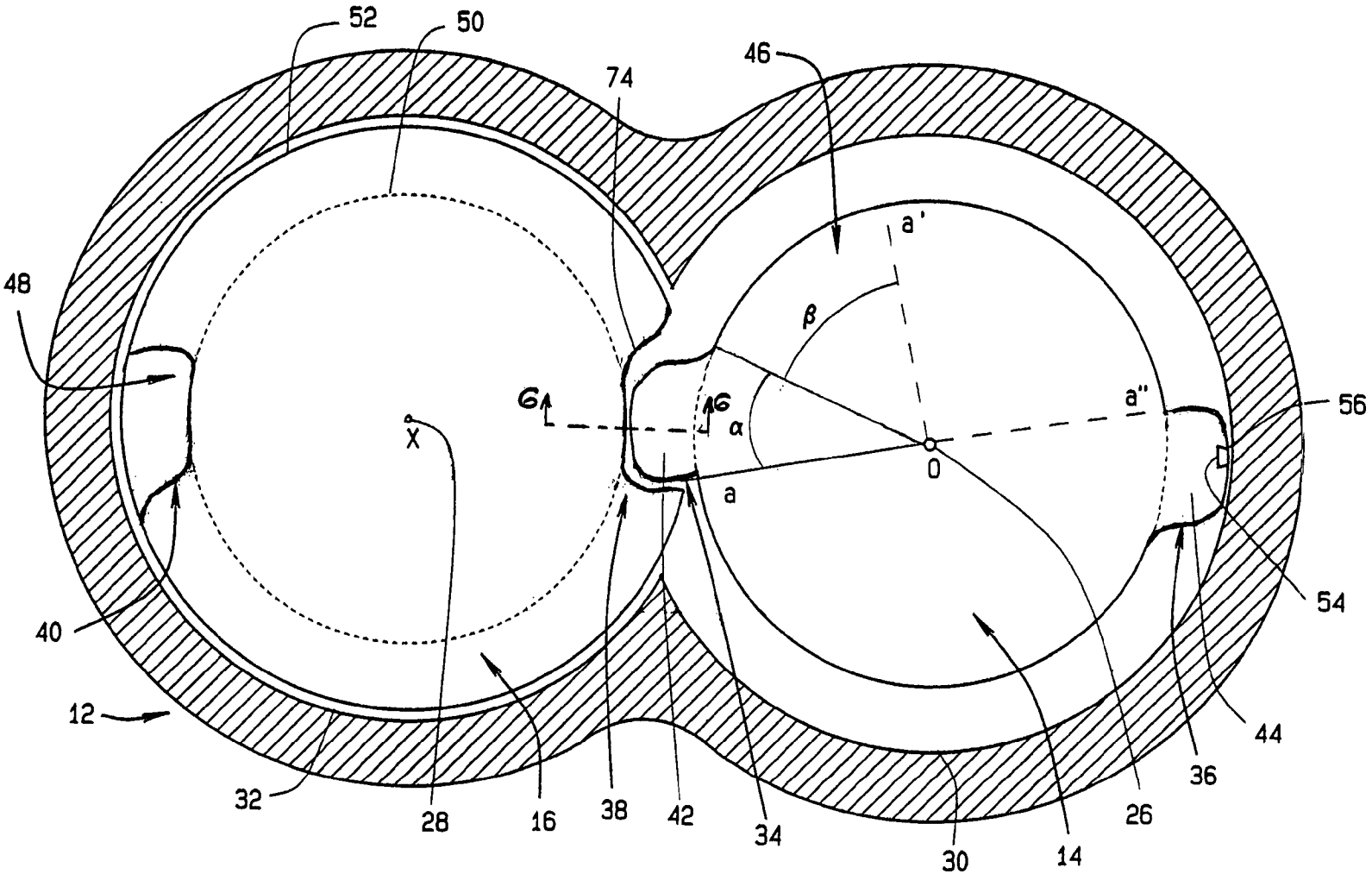
FIG. 2B illustrates a detailed cross-sectional view of another embodiment of the screw rotor device taken along the line 2—2 of FIG. 1.
Figure 3:
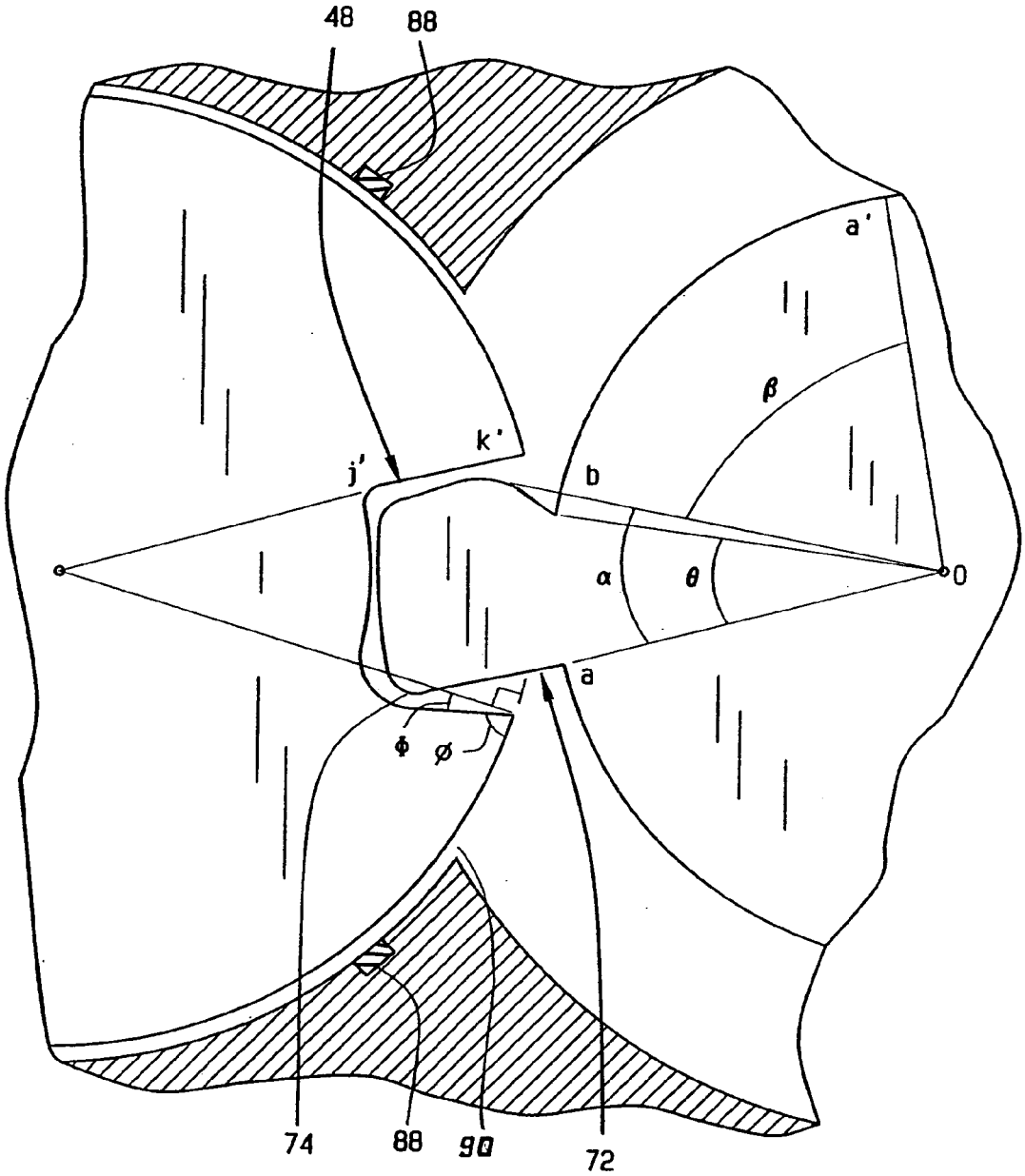
FIG. 3 illustrates a detailed cross-sectional view of the screw rotor device taken along line 3—3 of FIG. 1.

The pair of helical threads 34, 36 have a phase-offset aspect that is particularly described in reference to FIGS. 2A, 2B and 3 which show the cross-sectional profile of the screw rotor device through line 2—2, the two-dimensional profile being represented in the plane perpendicular to the axes of rotation 26, 28. The phase-offset aspect is also discussed below in reference to FIG. 7A, and is also shown in the embodiments that are illustrated by FIGS. 10–16. The cross-section of the pair of helical threads 34, 36 includes a pair of corresponding teeth 42, 44 bounding a toothless sector 46. The phase-offset of the helical threads 34, 36 is defined by the arc angle β subtending the toothless sector 46 which depends on the arc angle α of either one of the teeth 42, 44. In particular, for phase-offset helical threads, the toothless sector 46 has an arc angle β that is preferably equal to or greater than the arc angle α subtending either one of the teeth 42, 44. The preferred phase-offset relationship between arc angle β and arc angle α is particularly defined by equation (1) below:

$$\text{Arc Angle } \beta \geqq M^{*}\text{Arc Angle } \alpha,\ M \geqq 1 \qquad (1)$$

As illustrated in FIGS. 2A, 2B, 10A, 12 and 13, the angle between ray segment oa and ray segment ob, subtending tooth 42, is arc angle α. According to the phase-offset definition provided above, arc angle β of the toothless sector 46 extends from ray segment ob to ray segment oa', which would generally correspond to a multiplier (M) of the arc of arc angle α. It is believed that the highest efficiencies may be obtained by phase-offset multipliers of two or greater. In the preferred embodiment, the arc angle β of the toothless sector 46 extends approximately five times arc angle α to ray segment oa", corresponding to a phase-offset multiplier of five (5). Accordingly, another two additional teeth could be potentially fit on opposite sides of the male rotor 14 between the teeth 42, 44.

For balancing the male rotor 14, it is preferable to have equal radial spacing of the teeth. An even number of teeth is not necessary because an odd number of teeth could also be equally spaced around male rotor 14. Additionally, the number of teeth that can fit around male rotor 14 is not particularly limited by the preferred embodiment. Generally, arc angle β is proportionally greater than arc angle α according to the phase-offset multiplier. Accordingly, arc angle β of the toothless sector 46 can decrease proportionally to any decrease in the arc angle α of the teeth 42, 44, thereby allowing more teeth to be added to male rotor 14 while maintaining the phase-offset relationship. Whatever the number of teeth on the male rotor 14, the female rotor has a corresponding number of helical grooves. Accordingly, the helical grooves 38, 40 have a phase-offset aspect corresponding to that of the helical threads 34, 36. Therefore, the female rotor has the same number of helical grooves 38, 40 as the number of helical threads 34, 36 on the male rotor, and the helix angle of the helical grooves 38, 40 is opposite-handed from the helix angle of the helical threads 34, 36. It will be appreciated that, for a given rotor diameter, the helix angle of the grooves and threads actually vary depending on their depth. In particular, referring back to FIG. 1, the top land of the thread will have a lesser helix angle than the root of the thread, and the trough of the groove will have a greater helix angle than the ridge of the groove.

In one embodiment, each of the helical grooves 38, 40 has a cut-back concave profile 48 and corresponding radially narrowing axial, widths from locations between the minor diameter 50 (md) and the major diameter 52 (MD) towards the major diameter 52 at the periphery of the female rotor 16. The cut-back concave profile 48 includes line segment jk radially extending between the minor diameter 50 and the major diameter 52 on a ray from axis 28, line segment lm radially extending between the minor diameter 50 and the major diameter 52, and a minor diameter arc lj circumferentially extending between the line segments jk, lm. Line segment jk is substantially perpendicular to major diameter 52 at the periphery of the female rotor 16, and line segment lmn preferably has a radius lm combined with a straight segment mn. In particular, radius lm is between straight segment mn and minor diameter arc lj and straight segment mn intersects major diameter 52 at an acute exterior angle $\phi$, resulting in a cut-back angle $\Phi$ defined by equation (2) below.

$$\text{Cut-Back Angle } \Phi = \text{Right Angle } (90°) - \text{Exterior Angle } \phi, \quad (2)$$

The cut-back angle $\Phi$ and the substantially perpendicular angle at opposite sides of the cut-back concave profile 48 result in the radial narrowing axial width at the periphery of the female rotor 16. In this cut-back embodiment, the helical grooves 38, 40 are opposite from each other about axis 28 such that line segment jk for each of the pair of helical grooves 38, 40 is directly in-line with each other through axis 28. Accordingly, in the cut-back embodiment, line segment kjxj'k' is preferably straight.

Figure 4:
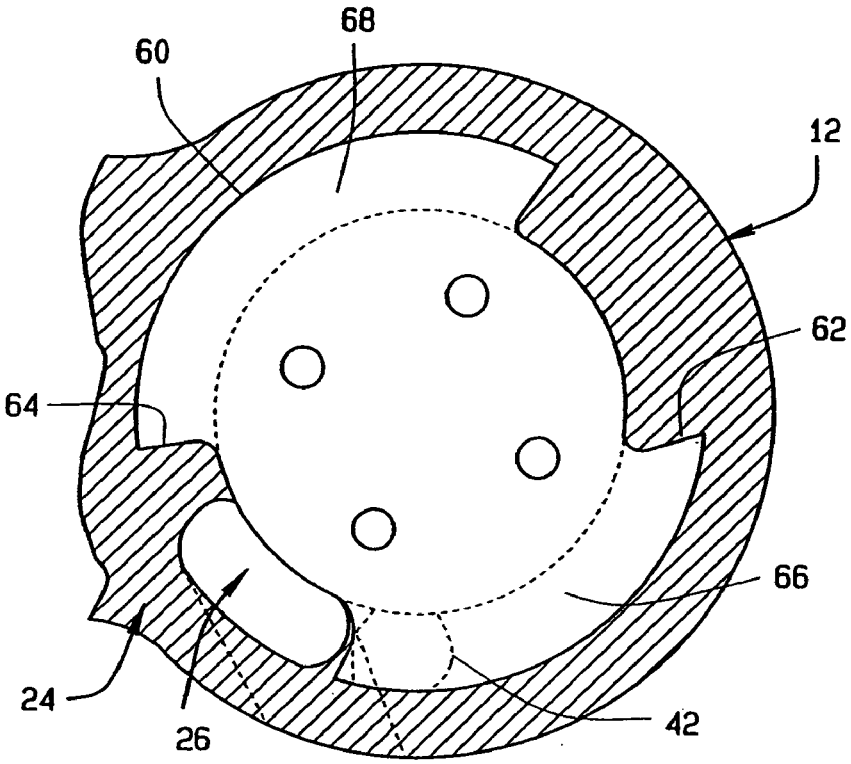
FIG. 4 illustrates a cross-sectional view of the screw rotor device taken along line 44 of FIG. 1.

In the preferred embodiment of the present invention, the screw rotor device 10 operates as a screw compressor on a gaseous working fluid. Each of the helical threads 34, 36 may also include a distal labyrinth seal 54, and a sealant strip 56 may also be wedged within the distal labyrinth seal 54. The distal labyrinth seal 54 may also be formed by a number of striations at the tip of the helical threads (not shown). When operating as a screw compressor, the screw rotor device 10 may use a valve 58 operatively communicating with the outlet port 20. As one example, a valve 58 is a pressure timing plate 60 attached to and rotating with the male rotor 14 and is located between the male rotor 14 and the outlet port 20. As particularly illustrated in FIG. 4, the pressure timing plate 60 has a pair of cutouts 62, 64 that sequentially open to the outlet port 20. Between the cutouts 62, 64, the pressure timing plate 60 forms additional boundaries 66, 68 to the spaces 39, 41 respectively. As the male rotor 14 counter-rotates with the female rotor 16, boundaries 66, 68 cause the volume in the spaces 39, 41 to decrease and the pressure of the working fluid increases. Then, as the cutouts 62, 64 respectively pass over the outlet port 20, the pressurized working fluid is forced out of the spaces 39, 41 and the spaces 39, 41 continue to decrease in volume until the bottom of the respective helical threads 34, 36 pass over the outlet port.

Figure 5:
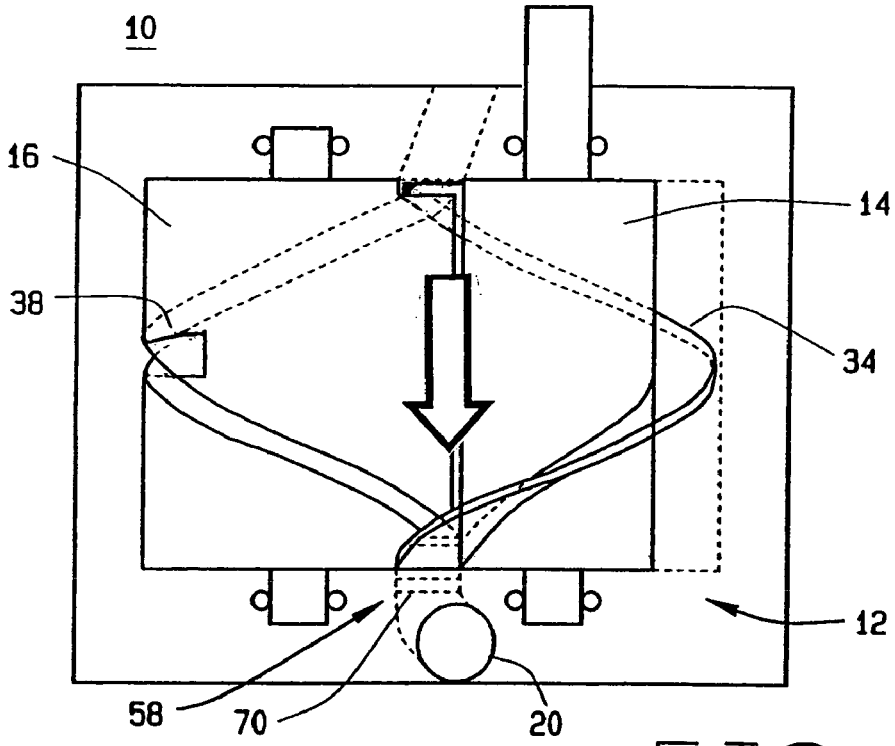
FIG. 5 illustrates a schematic diagram of an alternative embodiment of the invention.

FIG. 5 illustrates an another embodiment of the screw rotor device 10 that only has one helical thread 34 intermeshing with the corresponding helical groove 38 and preferably has a valve 58 at the outlet port 20. As illustrated in FIG. 5, the valve 58 can be a reed valve 70 attached to the housing 12. In this single-thread embodiment, weights may be added to the male rotor 14 and the female rotor 16 for balancing. The helical groove 38 can have the cut-back concave profile 48 described above, and the male rotor 14 again counter-rotates with respect to the female rotor 16.

The single-thread embodiment also illustrates another aspect of the screw rotor device 10 invention. In this embodiment, the length of the screw rotor device 10 is approximately one single pitch of the helical thread 34 and groove 38. The pitch of a screw is generally defined as the distance from any point on a screw thread to a corresponding point on the next thread, measured parallel to the axis and on the same side of the axis. The particular screw rotor device 10 illustrated in FIG. 5 has a single thread 34 and corresponding groove 38. Therefore, a single pitch of the 34 and groove 38 requires a complete 360° helical twist of the thread 34 and corresponding groove 38. The present invention is directed toward screw rotor devices 10 having the identical number of threads and grooves (N), and the helical twist required to provide the single pitch is merely defined by the number of threads and grooves (N=1, 2, 3, 4, . . . ) according to equation (3) below.

$$\text{Single Pitch Helical Twist} = 360°/N \quad (3)$$

Figure 7A:
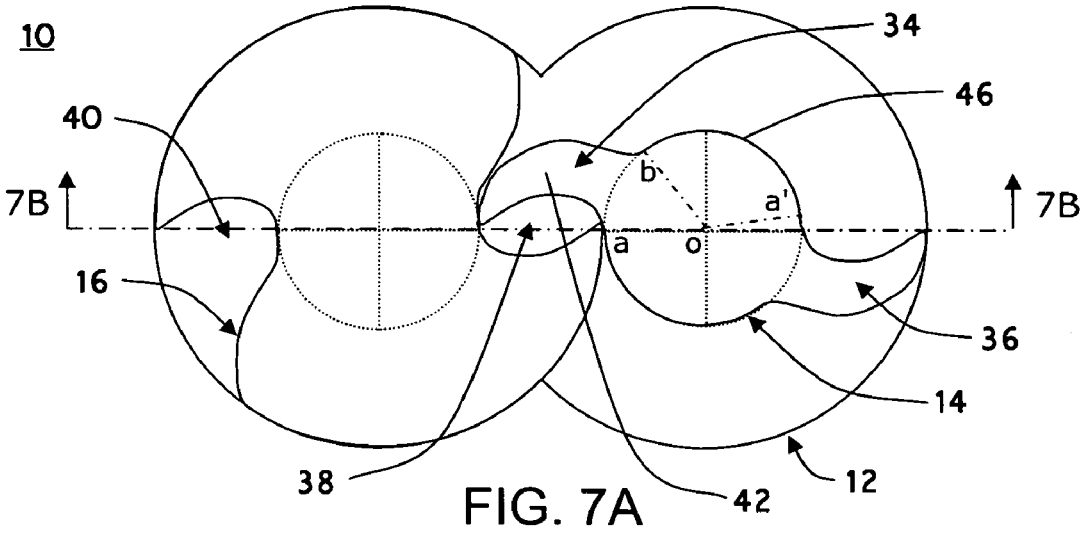
FIG. 7A illustrates an axial cross-sectional view of another alternative embodiment of the screw rotor device according to the present invention.
Figure 7B:
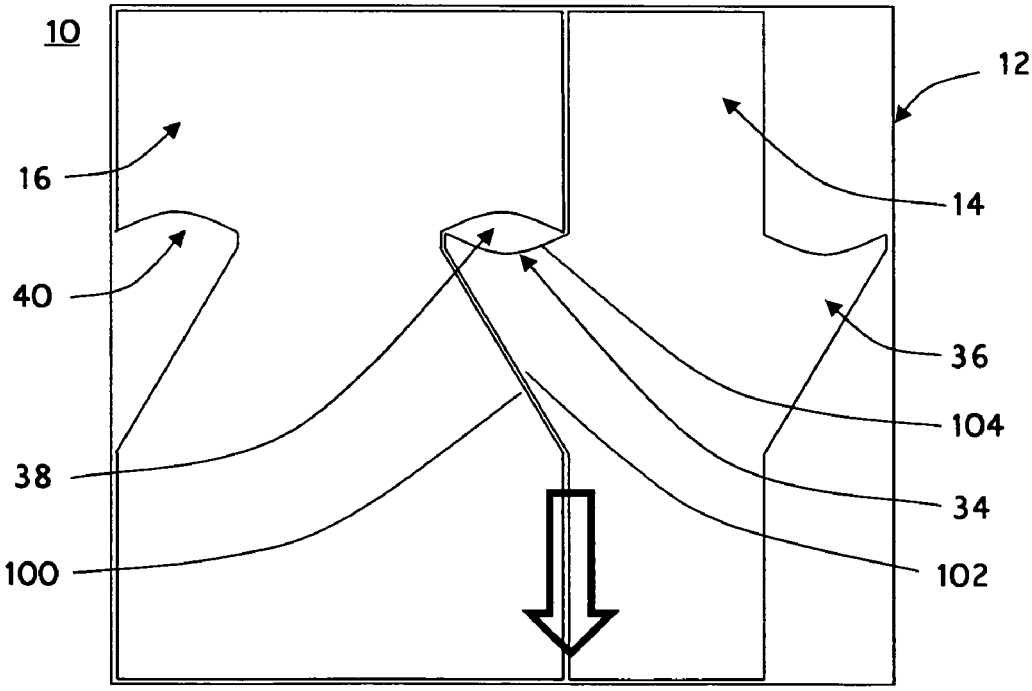
FIG. 7B illustrates a lengthwise cross-sectional view of the screw rotor device taken along line 7B—7B of FIG. 7A.

Of course, it will be appreciated that even in the example in which the length of the screw rotor device 10 is a single pitch, the pitch length can be changed by altering the helix angle of the threads and grooves. The pitch length increases as the helix angle steepens. The screw rotor device 10 illustrated in FIG. 1 has a pair of threads 34, 36 and a corresponding pair of helical grooves 38, 40 (N=2). Therefore, a single pitch of these rotors would only require a 180° helical twist (360°/2). However, it is evident that the screw rotor device 10, as illustrated in FIG. 1, has a length slightly greater than two pitches. Therefore, for the given length of the rotors, the helix angle for the threads and grooves would have to increase for the rotors to have a single pitch length. For example, FIGS. 7A and 7B illustrate a screw rotor device 10 that has a pair of threads 34, 36 and a corresponding pair of helical grooves 38, 40 that have a 180° helical twist. Accordingly, FIGS. 7A and 7B particularly illustrate rotor lengths that have a single pitch of the threads 34, 36 and grooves 38, 40. While it may be preferable, and in some cases even advantageous, to design the rotor length to approximately a single pitch for certain thread designs, it is not a necessary design limitation for screw rotors according to the present invention.

The screw rotor device 10 illustrated in FIG. 7A also incorporates the phase-offset relationship into its design. The angle between ray segment oa and ray segment ob, subtending tooth 42, is arc angle $\alpha$. According to the phase-offset definition provided above, arc angle $\beta$ of the toothless sector 46 extends from ray segment ob to ray segment oa', which would correspond to the multiplier (M) and arc angle $\alpha$.

As particularly illustrated in FIG. 3, the helical thread 34 in this embodiment has a cut-in convex profile 72 that meshes with the cut-back concave profile 48 of the helical groove 38. The cut-in convex profile 72 has a tooth segment 74 radially extending from minor diameter arc ab. The tooth segment 74 is subtended by arc angle $\alpha$ and is further defined by equation (4) below according to arc angle $\theta$ for minor diameter arc ab.

$$\text{Arc Angle } \alpha > \text{Arc Angle } \theta \quad (4)$$

The phase-offset relationship defined for a pair of threads is also applicable to the male rotor 14 with the single thread 34, such that the toothless sector 46 must have an arc angle $\beta$ that is at least twice the arc angle $\alpha$ of the single helical thread 34. The male rotor 14 circumference is 360°. Therefore, to design a rotor having a phase-offset multiplier of at least 2 and a single thread, arc angle $\beta$ for the toothless sector 46 must at least 240° and arc angle $\alpha$ can be no greater than 120°. Similarly, for designing rotor having a phase-offset multiplier of at least 2 with the pair of threads 34, 36, 60° is the maximum arc angle $\alpha$ that could satisfy the such a minimum phase-offset multiplier of two (2) and 30° would be the maximum arc angle $\alpha$ that could satisfy the phase-offset multiplier of five (5). For practical purposes, it is likely that only large diameter rotors would have a phase-offset multiplier of 50 (3° maximum arc angle $\alpha$) and manufacturing issues may limit higher multipliers.

The male rotor 14 and female rotor 16 each has a respective central shaft 76, 78. The shafts 76, 78 are rotatably mounted within the housing 12 through bearings 80 and seals 82. The male rotor 14 and female rotor 16 are linked to each other through a pair of counter-rotating gears 84, 86 that are respectively attached to the shafts 76, 78. The central shaft 76 of the male rotor 14 has one end extending out of the housing 12. When the screw rotor device 10 operates as a compressor, shaft 76 is rotated causing male rotor 14 to rotate. The male rotor 14 causes the female rotor 16 to counter-rotate through the gears 84, 86, and the helical threads 34, 36 intermesh with the helical grooves 38, 40.

As described above, the distal labyrinth seal 54 helps sealing between each of the helical threads 34, 36 on the male rotor 14 and the cylindrical bore 30 in the housing 12. Similarly, as particularly illustrated in FIG. 3, axial seals 88 may be formed in the housing 12 along the length of the cylindrical bore 32 to help sealing at the periphery of the female rotor 16. As the male rotor 14 and female rotor 16 transition between meshing with each other and respectively sealing around the housing 12, a small gap 90 is formed between the male rotor 14, the female rotor 16 and the housing 12. The rotors 14, 16 fit in the housing 12 with close tolerances between the rotors and the housing and the rotors themselves have close tolerances between the threads 34, 36 and grooves 38, 40. In particular, the top land 120 of the threads 34, 36 and the female rotor's major diameter 52 are in a sealing relationship with the cylindrical bores 30, 32 of the housing 12, respectively. Additionally, the top land 120 of the threads 34, 36 is also in a sealing relationship with the trough or bottom land 110 of the groove 38, 40. As discussed in detail with regard to FIGS. 10–16 below, the sealing relationship can be in the form of a sealing line or a sealing area. Generally, close tolerances that give rise to the sealing relationship are on the order of magnitude of approximately 0.003 inches for a 35 cubic feet per minute (CFM) screw rotor compressor system, although the tolerances could be relaxed depending on the size of the screw rotor device and the amount and rate of the working fluid being compressed, pumped, or expanded. For example, if the threads and grooves are designed to displace 35 CFM for rotors with diameters of approximately 3 inches, a larger compressor having similar threads and grooves could have a slightly larger tolerance while maintaining a comparable thermodynamic efficiency. As discussed in detail below, there are also other factors that may affect the sealing tolerances that for a particular screw rotor system, such as the application in which the screw rotor is to be used.

It will also be appreciated that, depending on the application, the temperature range experienced by the rotors could vary, and the tolerances can be designed to account for thermal expansion and contraction of the rotors as well as the housing. Also, the material for the rotors and the housing can be selected such that the sealing distances, or tolerances, do not vary substantially throughout the operating range of the screw rotor system. For example, the materials may have a similar modulus of thermal expansion or may be selected such that they reach an optimal seal at a particular design point or in an operating region at steady state condition.

As discussed above, the preferred embodiment of the screw rotor device 10 is designed to operate as a compressor. The screw rotor device 10 can be also be used as an expander. When acting as an expander, gas having a pressure higher than ambient pressure enters the screw rotor device 10 through the outlet port 20, valve 58 being optional. The pressure of the gas forces rotation of the male rotor 14 and the female rotor 16. As the gas expands into the spaces 39, 41, work is extracted through the end of shaft 76 that extends out of the housing 12. The pressure in the spaces 39, 41 decreases as the gas moves towards the inlet port 18 and exits into ambient pressure at the inlet port 18. The screw rotor device 10 can operate with a gaseous working fluid and may also be used as a pump for a liquid working fluid. For pumping liquids, a valve may also be used to prevent the fluid from backing into the rotor.

Figure 6A:
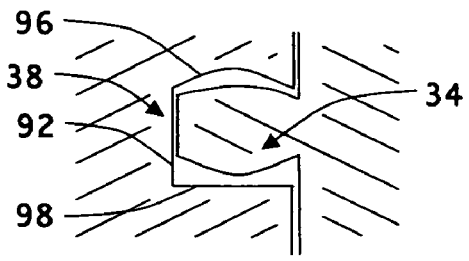
FIG. 6A illustrates a detailed cross-sectional view of the screw rotor device taken along line 6—6 of FIG. 2A.
Figure 6B:
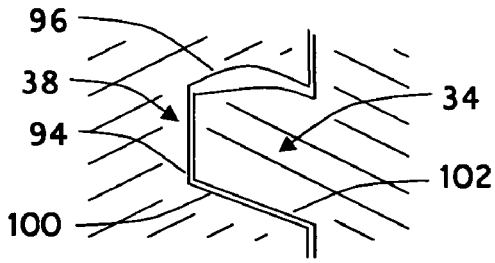
FIG. 6B illustrates a detailed cross-sectional view of the screw rotor device taken along line 6—6 of FIG. 2B.

FIGS. 6A and 6B illustrate a detailed cross-sectional view of the helical grooves and helical threads from FIGS. 2A and 2B, respectively. These views illustrate the differences between an acme thread profile 92, which may include one or more involute curves, and another feature of the present invention, a buttress thread profile 94. Between the minor diameter 50 and the major diameter 52 of the female rotor, the acme thread profile 92 of the helical groove 38 includes a concave line 96 and a substantially straight line 98 opposite therefrom. The buttress thread profile 94 also includes a concave line 96 but is particularly defined by a diagonal straight line 100. On the male rotor, the acme thread 92 profile of the helical thread 34 is also between the major and minor diameters and includes a pair of opposing convex curves. In comparison, the buttress thread profile 94 has a diagonal straight line 102 that is parallel to and in close tolerance with the corresponding diagonal straight line 100 in the helical groove 38. In the particular example illustrated by FIG. 6B, a convex curve 104 is opposite the diagonal straight line 102.

FIGS. 7A and 7B particularly illustrate the screw rotor device 10 according to several aspects of the present invention, including the parallel diagonal straight lines 100, 102 of the buttress thread profile 94, phase-offset helical threads 34, 36, and the single pitch design of the male and female rotors 14, 16 within the housing 12. With regard to the particular example illustrated by FIG. 7B, the buttress thread profile 94 includes a concave curve 104 opposite from the diagonal straight line 102. It should be appreciated that the benefits of the present invention can be achieved with manufacturing tolerances, such as in the parallel diagonal straight lines 100, 102. In particular, tolerances in the parallel diagonal straight lines 100, 102 may allow for a slight radius of curvature between the diagonal lines and the major and minor diameters and an extremely slight divergence in the parallelism. It will be appreciated that manufacturing tolerances may vary depending on the type of material being used, such as metals, ceramics, plastics, and composites thereof, and depending on the manufacturing process, such as machining, extruding, casting, and combinations thereof.

FIGS. 8–11 illustrate an embodiment of the present invention that, like the embodiments discussed above significantly reduces the blow-hole gap, and as discussed below with regard to this embodiment, contrary to the currently held belief, the present invention can even eliminate the blow-hole gap entirely. As discussed above, earlier designs have failed to create a complete seal except for a single-pitch complete seal design, i.e., the buttress-thread design particularly set forth and claimed in co-pending U.S. application Ser. No. 10/283,422. However, the present invention eliminates the blow-hole gap as well as other internal leakages that reduce the thermodynamic efficiency and the volumetric efficiency of screw rotor devices. In particular, in addition to the blow-hole gap described above, the present invention can eliminate or significantly reduce the following forms of internal leakage:

(1) gaps between the inlet port and/or outlet port in the housing and the rotors, resulting in less than complete capture or ejection of the working fluid through the rotors;

(2) gaps between the outer periphery of each rotor and the inner surface of the housing, through which the working fluid leaks around the top land of a thread or the ridge of a groove to an adjacent working volume, respectively; and (3) gaps between the front and back of the intermeshing male rotor thread and female rotor groove, through which the working fluid leaks from the pressurized side to the suction side.

To ensure that persons of ordinary skill in the art will appreciate the expansive scope of the present invention, it should be understood that while the prior art multi-pitch screw rotor designs were able to significantly reduce or eliminate the three forms of leakage above and the single-pitch, buttress-thread rotor designs were able significantly reduce or eliminate the blow-hole gap, no heretofore known screw compressor design has been able to eliminate or significantly reduce all of these internal leakages simultaneously and without limitation. While it is true that the buttress-thread rotor designs could significantly reduce or eliminate the blow-hole gap, its elimination came at the price that the complete seal would only work for a single-pitch, but not because of the blow-hole gap. Instead, when the buttress-thread rotor designs are used for multi-pitch screw rotors, the gap between the front and back of the intermeshing male rotor thread and female rotor groove could then cause significant leakage from the high pressure side of the screw rotor to the low pressure or suction side of the rotor.

Gaps between the rotors themselves and between one or more of the screw rotors and the housing, such as gap 90 illustrated in FIG. 3 and discussed above, can be viewed as leak pathways. A leak pathway can be generally viewed as any stream tube between the male rotor and the female rotor or between one or more of the rotors and the housing, that extending from the front side to the back side or on one side, between a higher pressure region and a lower pressure reason. To define the stream tube, it can be formed by a set of continuous gaps with an effective diameter that exceeds an order of magnitude greater than a defined sealing tolerance for the screw rotor system. For example, a sealing tolerance can be based on the distance is between the top land of the thread and the bottom land of the groove. Alternatively, the sealing tolerance 106 can be based on the distance between one or more of the rotors and the housing. It does not matter what the actual distance the sealing tolerance is based on, just that the reference makes sense for the particular use of the screw rotor design. For the present invention, a thermodynamic efficiency approaching 85% has already been observed, and it is expected that a thermodynamic efficiency of 90% can be achieved. The thermodynamic efficiency of 85% and 90% should be attainable even according to the embodiments described herein when the positive displacement of the working fluid is controlled using a valve, such as the reed valve discussed above.

As an example of different tolerances for different applications, the screw rotor system 10 illustrated in FIG. 9 could be used as a fluid meter system or in a hydraulic system which does not run too fast and/or generate much heat. In such a system, the sealing tolerances should be zero (0), or as close to zero (0) as physically possible with machining and other manufacturing techniques and as required to allow for thermal expansion of the rotors, such as when the screw rotor system is used as an internal combustion engine. For another system, such as an adiabatic compressor or expander, the tolerances may be a little more relaxed. As discussed above, the tolerances can also vary depending on the size of the screw rotor system, being tighter for smaller systems and loosening for larger systems.

Generally, the sealing tolerance for the present invention, between the helical thread and the helical groove, can be set as a defined number, such as less than or equal to 0.003" or 0.001" or some other small distance. Even more generally, the sealing tolerance can be based on a ratio of the rotor diameters of the screw rotor system 10, such as a rule that the sealing tolerance being no greater than $1/1{,}000$ or $1/10{,}000$ of the male rotor diameter. Most generally, the sealing tolerance can be based on any geometric proximity which can be defined by the distance between the rotors themselves, the rotors and the housing, or any other distance that is relevant to sealing conditions. Depending on the geometric proximity that is selected, the sealing tolerance may be defined by the geometric proximity itself or can be based thereon, such as a sealing tolerance which is within an order of magnitude of the geometric proximity.

It will be appreciated that the gap 90 in the embodiment illustrated in FIG. 3A and discussed above is within a sealing tolerance that is within an order of magnitude of the distance between the top land of the thread and the bottom land of the groove. It will also be appreciated that the gap 90 in the embodiment illustrated in FIG. 10D is even smaller than that in FIG. 3A and that the gap can be completely eliminated by designing the cusp of the housing to be exactly at the point where the thread intersects the groove, such as discussed in detail below with regard to the thread and groove sealing at one or both cusps (SR-6 and SR-7). Accordingly, there is no leak pathway or stream-tube to show in the present invention. However, the leak pathways are already well defined in the art and understood by those skilled in the art. For example, the leak pathways are discussed in detail in U.S. Pat. No. 5,533,887, which is hereby incorporated by reference.

The particular structure and process of the present invention is discussed with reference to features particularly illustrated in FIG. 10C. As discussed above, the female rotor 16 has a major diameter and a helical groove 38. The groove recedes from the major diameter to a bottom land 110, or trough, situated between a leading side 112 and a trailing side 114, which are respectively shown as the bottom side and top side in the illustration. The leading side and trailing side respectively include a leading ridge 116 and a trailing ridge 118 at the major diameter. The male rotor 14 has a minor diameter and a helical thread 36 which, as discussed above, rotatably intermeshes in phase with the helical groove. The helical thread extends from the minor diameter to a top land 120 situated between a leading face 122 and a trailing face 124, which are respectively shown as the bottom face and top face in the illustration. The leading face and trailing face include a leading edge 126 and a trailing edge 128, respectively. The housing 12 has a front cusp 130 along its front side FS and a back cusp 132 along its back side. The helical thread is connected to the male rotor minor diameter through its root portion 134.

Figure 10A:
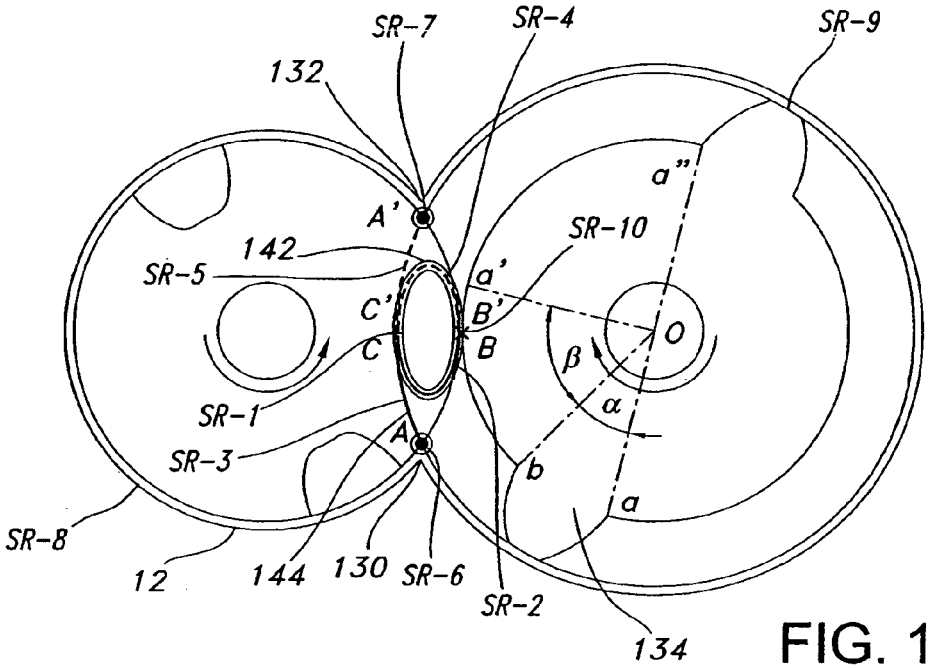
FIG. 10A illustrates a cross-sectional view of the screw rotor device according to the embodiment of the invention in FIGS. 8A–8D and 9.
Figure 10B:
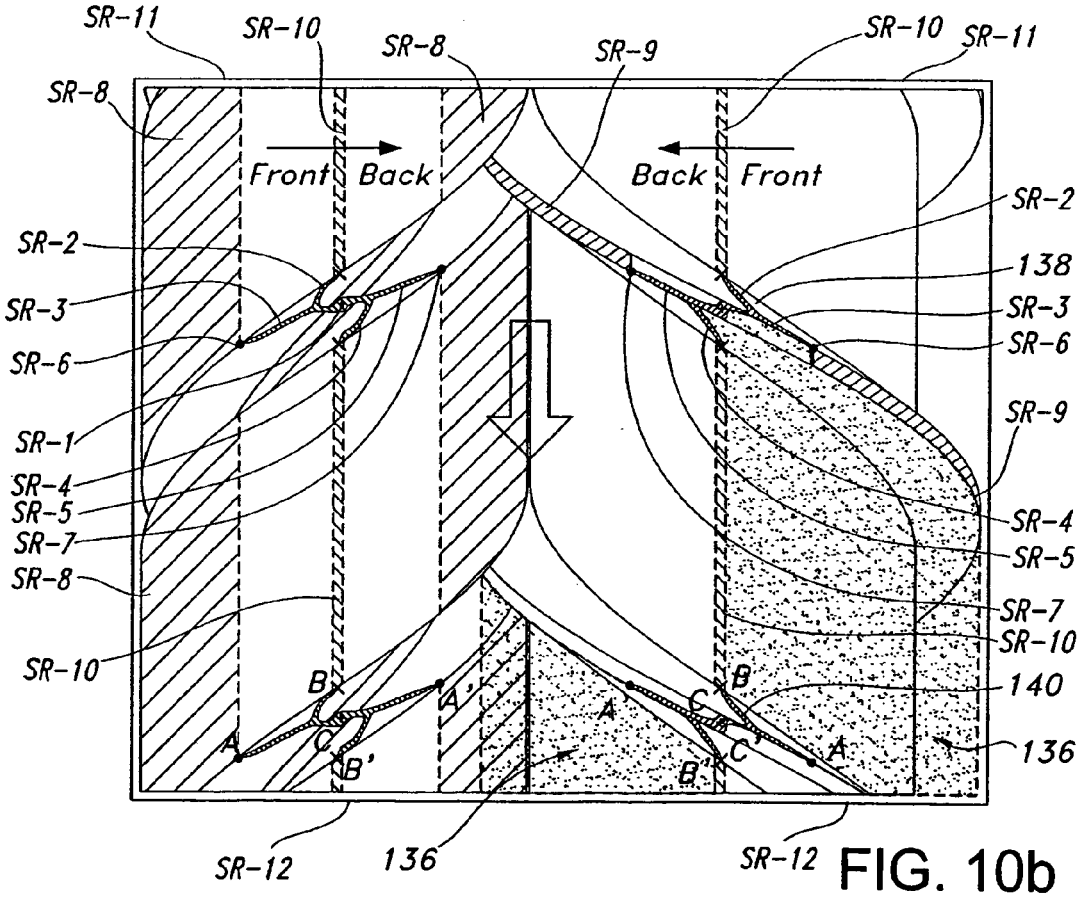
FIG. 10B illustrates an elevation view of the screw rotor device according to the embodiment of the invention in FIGS. 8A–8D and 9 and with the rotors turned out 90° to show the sealing lines and areas between the rotors themselves and between the rotors and the housing.
Figure 10C:
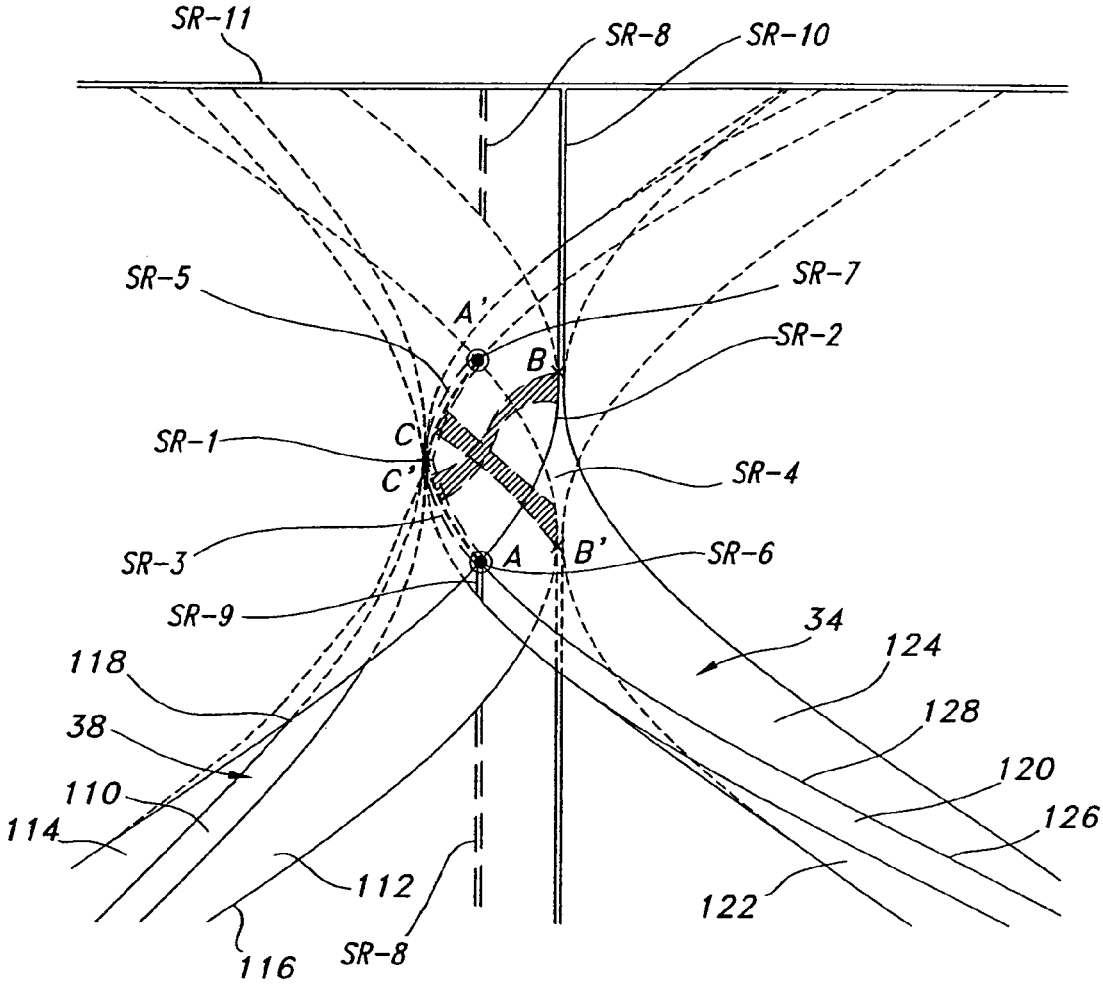
FIG. 10C illustrates an elevation view of the screw rotor device according to the embodiment of the invention in FIGS. 8A–8D and 9 and with the rotors not turned out 90° to show the sealing lines and areas as they exist between the rotors themselves and between the rotors and the housing.
Figure 10D:
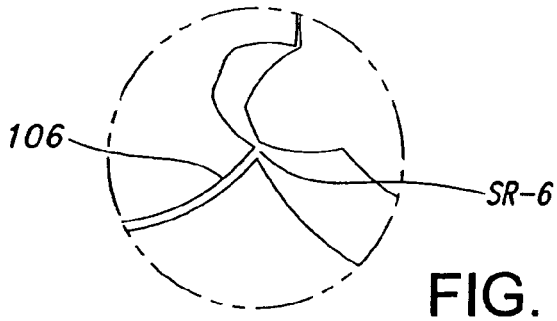
FIG. 10D shows a detail cross-sectional view of the screw rotor device according to the embodiment of the invention in FIGS. 8A–8D and 9 and showing the present invention's ability to eliminate of the blow-hole gap.
Figure 11A:
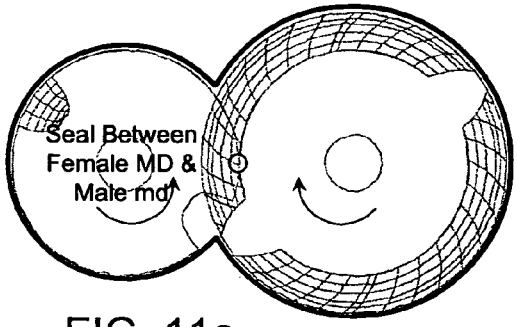
FIGS. 11A–11H show a series of cross-sectional views of the screw rotor device according to the embodiment of the invention in FIGS. 8A–8D, 9 and 10 as the male and female rotors intermesh and seal.
Figure 11B:
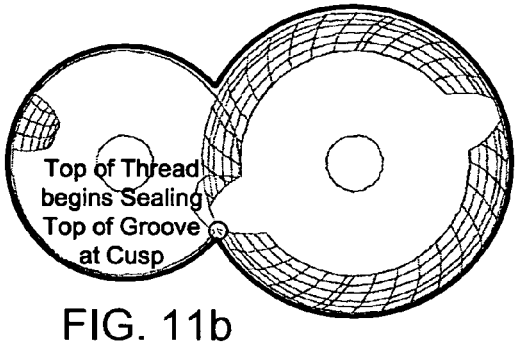
Figure 11C:
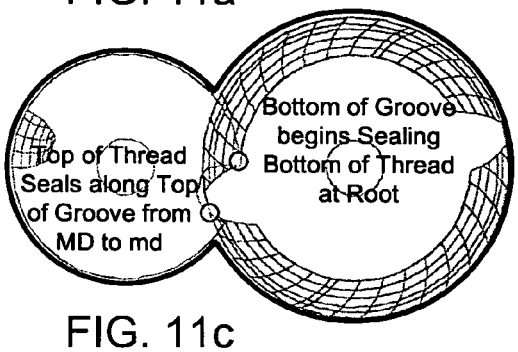
Figure 11D:
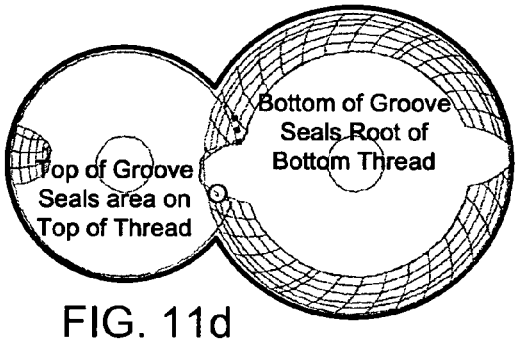
Figure 11E:
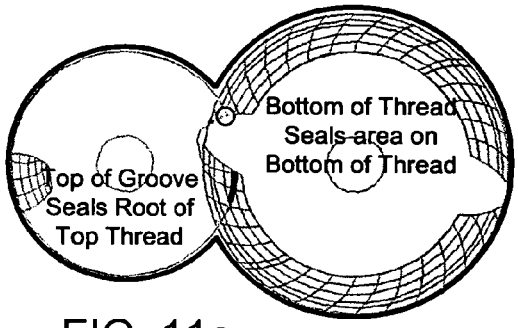
Figure 11F:
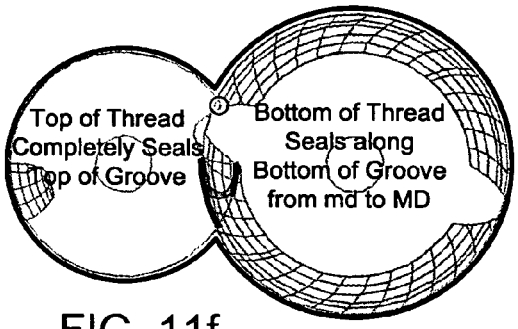
Figure 11G:
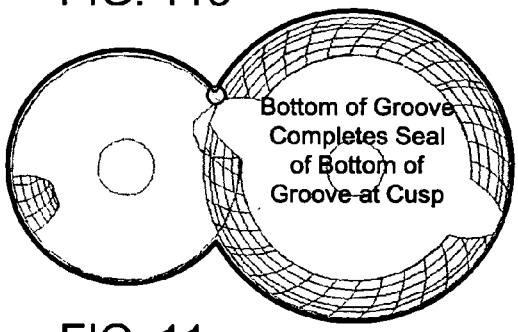
Figure 11H:
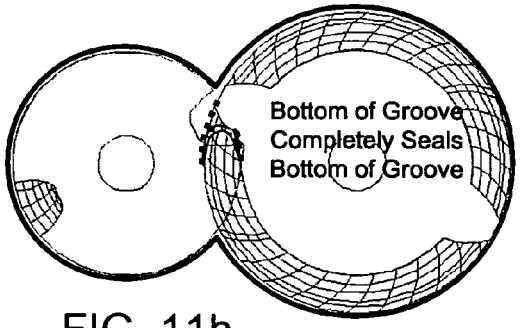

To show the sealing relationships of the present invention, FIG. 10C uses the symbols A, B and C to refer to the front side sealing of the screw rotor and A', B' and C' to refer to the back side sealing of the screw rotor. It will be appreciated that the top and bottom of the screw rotor are relative to its positioning and are merely used for simplicity of reference in relationship with the drawing. Generally, according to the direction of travel shown in FIGS. 10A and 10B, the top portions are the trailing portions and the bottom portions are the leading portions. Of course, if the direction of the rotors is reversed, the top portions would then be the leading portions and the bottom portions would then be the trailing portions. Also, FIG. 10C uses alpha-numeric reference codes and other symbols to particularly identify the following Sealing Regions (SR), which may also be referred to as sealing relationships:

SR-1: ✝(CC')—top land seals with bottom land (1st SR)

SR-2: A/CB—trailing ridge seals, at least partially, along trailing face (2nd SR)

SR-3: AC—trailing edge seals with trailing side (3rd SR)

SR-4: A'/C'B'—leading face seals with leading ridge (4th SR)

SR-5: A'C'—leading edge seals with leading side (5th SR)

SR-6/SR-7: ⊙—triple seal between ridge, edge and cusp, A-front (6th SR) & A'-back (7th SR)

SR-8: =||—major diameter of female rotor seals with cylindrical bore (8th SR)

SR-9: ||=—top land seals with cylindrical bore (9th SR)

SR-10: ⋔—female rotor major diameter seals with male rotor minor diameter (10th SR), including the seal between the groove's ridge and the thread's root portion, ✖B-top & ✖B'-bottom SR-11/SR-12: |||—housing ends seal with respective ends of rotor (11th SR & 12th SR)

As summarized in the listing above and particularly illustrated in FIG. 10C, the sealing relationships are described in detail below. The first sealing relationship SR-1 has a center, intermeshing sealing area defined by the geometries of the top land and the bottom land. The second sealing relationship SR-2 has a front, outer sealing line defined by geometries of the trailing face and the trailing ridge. The third sealing relationship SR-3 has a front, inner sealing line defined by geometries of the trailing edge and the trailing side. The fourth sealing relationship SR-4 has a back, outer sealing line defined by geometries of the leading face and the leading ridge. The fifth sealing relationship SR-5 has a back, inner sealing line defined by geometries of the leading edge and the leading side. The front, outer sealing line and the front, inner sealing line define boundaries of a front, intermeshing sealing area between the trailing face and the trailing side and intersect at a common front sealing point according to the sixth sealing relationship SR-6 defined by intersection of trailing edge, trailing ridge and front cusp. The back, outer sealing line and the back, inner sealing line define boundaries of a back, intermeshing sealing area between the leading face and the leading side and intersect at a common back sealing point according to the seventh sealing relationship SR-7 defined by intersection of leading edge, leading ridge and back cusp. The eighth sealing relationship SR-8 has a first peripheral sealing area defined by geometries of female rotor major diameter and the cylindrical bores. The ninth sealing relationship SR-9 has a second peripheral sealing area defined by geometries of the top land and the cylindrical bores. The tenth sealing relationship SR-10 has a center, non-meshing sealing area defined by geometries of the female rotor major diameter and the male rotor minor diameter, and includes the seal between the groove's ridge and the thread's root portion. As with most screw rotor compressors, the ends of the female rotor and the male rotor are in a sealing relationship with the ends of the housing, i.e., the eleventh sealing relationship SR-11 and twelfth sealing relationship SR-12. It will be appreciated that a number of these sealing regions are sealing areas while others may be sealing lines, depending on the particular selection of design variables for the rotors, discussed below.

The creation and progression of these seals, as the male and female rotors intermesh, is illustrated in FIGS. 11A–11H. These illustrations show a series of cross-sectional views of the screw rotor device, and the particular sealing regions are shown and described with reference thereto. Even before the thread 36 and the groove 38 begin sealing, there is a seal between the female rotor's major diameter and the male rotor's minor diameter. On the front side of the screw rotors 14, 16, the top of thread 124 begins sealing the top of the groove 114 right at the front cusp 130 and, as the rotors continue to intermesh, continues sealing along the top of the groove for the entire length from the female rotor's major diameter to its minor diameter (points A and C respectively illustrated on FIG. 10A). On the back side of the screw rotors, the bottom of the groove 112 begins sealing the bottom of the thread 122 at its root 134 (point B illustrated on FIG. 10*a*), and, as the rotors continue to intermesh, continues to seal more of the root until the bottom of the thread starts sealing along the bottom of the groove and ultimately seals along the entire bottom of the groove from the female rotor's minor diameter to its major diameter (points A' and C' respectively illustrated on FIG. 10A). Intermediate points lining the top and bottom of the grooves also respectively seal with intermediate points lining the top and bottom of the threads. The bottom of the groove completes the seal of the bottom of the groove at the back cusp 132.

As discussed in detail below, with regard to the illustrations in FIGS. 14–16 and 17, all of these seals can be designed into the family of screw rotors according to the present invention, and by incorporating all of these seals into a screw rotor system, all of the leaks discussed above, including the blow-hole gap can be simultaneously reduced to within specified tolerances, also discussed above. With the buttress-thread rotor designs (see FIGS. 7A and 7B), the blow-hole gap can still be eliminated, but the complete seal is limited to a single-pitch because, with multiple-pitch rotors, a gap 134 exists between the trailing side of the groove and the trailing face of the thread (see FIG. 13E) which could cause significant leakage from the high pressure side of the screw rotor system to the low pressure or suction side of the screw rotor system.

According to the designs of the other non-buttress thread embodiments of the present invention, the gap between the trailing side of the groove and the trailing face of the thread does not exist, even when the screw rotors are multiple-pitch designs. Generally speaking, the buttress thread designs have a single-sided sealing relationship, i.e. between the leading side 112 of the groove 38 and the leading face 122 of the thread 36, whereas the other designs have a double-sided sealing relationship between the leading side 112 of the groove 38 and the leading face 122 of the thread 36 and between the trailing side 114 of the groove 38 and the trailing face 124 of the thread 36. The double-sided sealing relationship can be particularly defined by the first sealing relationship SR-1, the second sealing relationship SR-2, the third sealing relationship SR-3, the fourth sealing relationship SR-4, and the fifth sealing relationship SR-5. In this way, no leak pathway is provided through this double-sided sealing relationship. An illustration of this double-sided sealing 136 is particularly shown for multiple-pitch rotors 138, 140 in FIG. 10B. In particular, there is a leading axial seal 142 between the leading face of the thread and the leading side of the groove and a trailing axial seal 144 between the trailing face of the thread and the trailing side of the groove, and these sealing regions can be sealing areas. For compressor applications, the leading face/leading side seal may be more important than the trailing face/trailing side seal because the trailing face seal meets with and "disappears" into the end seal as the compression stroke is completed (see FIG. 10B). However, the trailing face/trailing side seal can be especially useful if it is desired to maintain a pre-compression of the working fluid, i.e., even before the thread seals with the groove.

Although similar groove shapes appear to be shown in prior art screw rotors and similar thread shapes appear to be shown in other prior art screw rotors, not only were such threads and grooves never before combined in a single screw rotor system, none of these prior art references ever even suggested that such grooves should be combined with the thread of the other references. In fact, none of these prior art designs were based on the present design method. Therefore, the threads and grooves of all of these prior art screw rotors fail to satisfy the structural features disclosed and claimed for the thread and groove of the present invention. Additionally, the prior art references fail to disclose the cooperative relationships between the thread, groove and cusps of the housing, as disclosed and claimed by the present invention. Finally, none of the prior art references disclose or suggest the design process of the present invention. In fact, as discussed in the Background of the Invention section above, the prior art actually suggests that it is not possible to have any design process, or resulting design, which eliminates the blow-hole gap.

Figure 14:
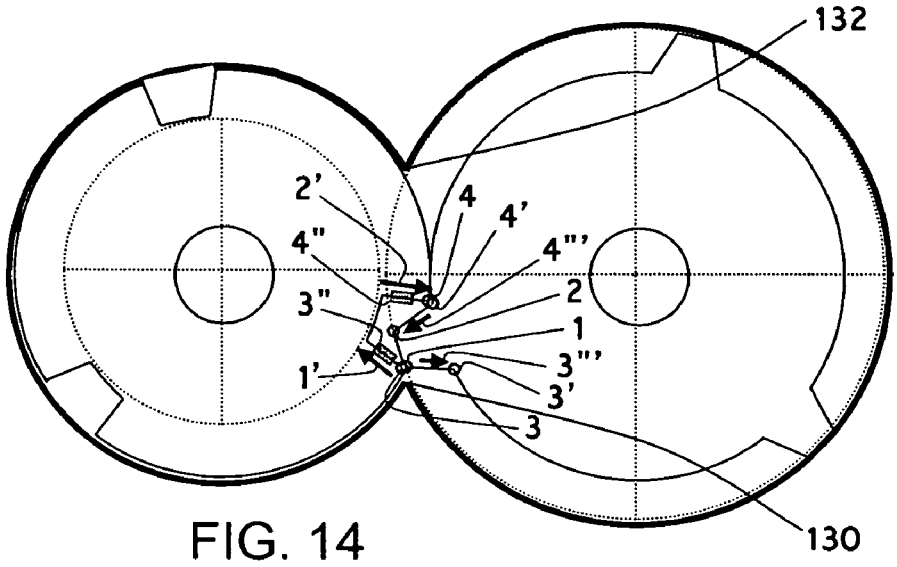
FIGS. 14–16 show a schematic representation of the rotor design process according to the present invention along with families of screw rotor devices resulting from the rotor design process.
Figure 15:
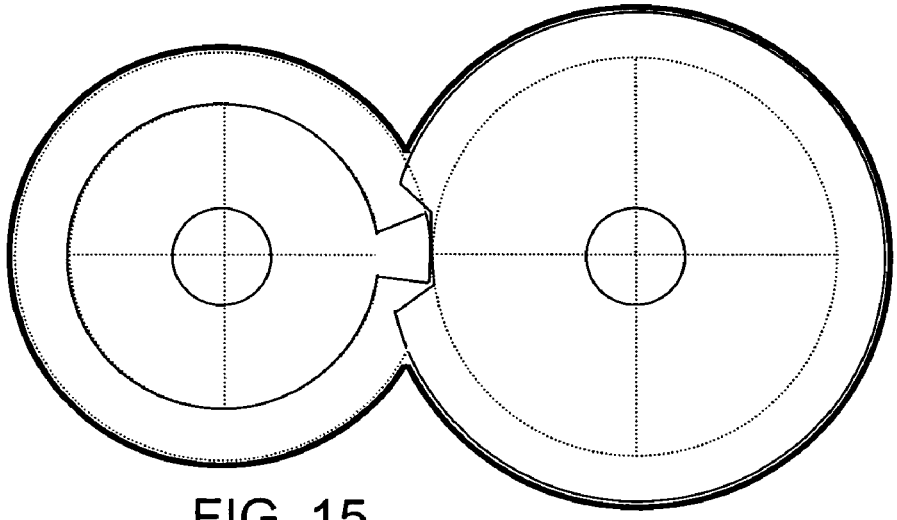
Figure 16:
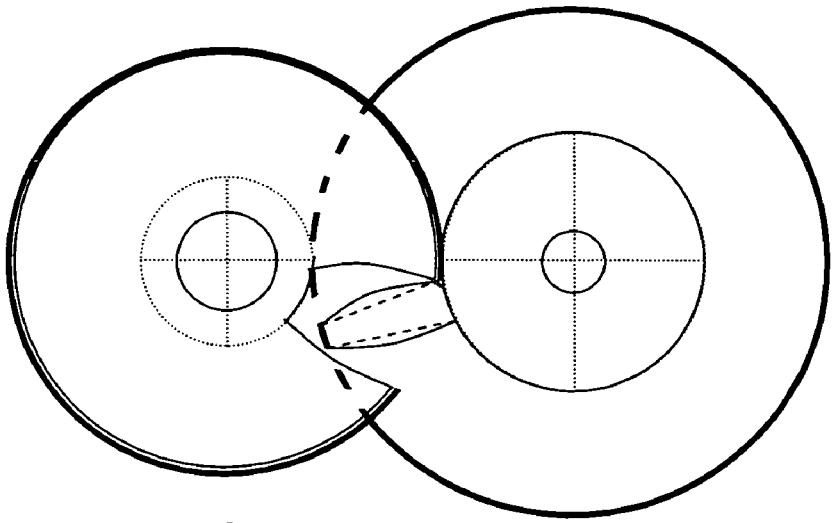
Figure 17:
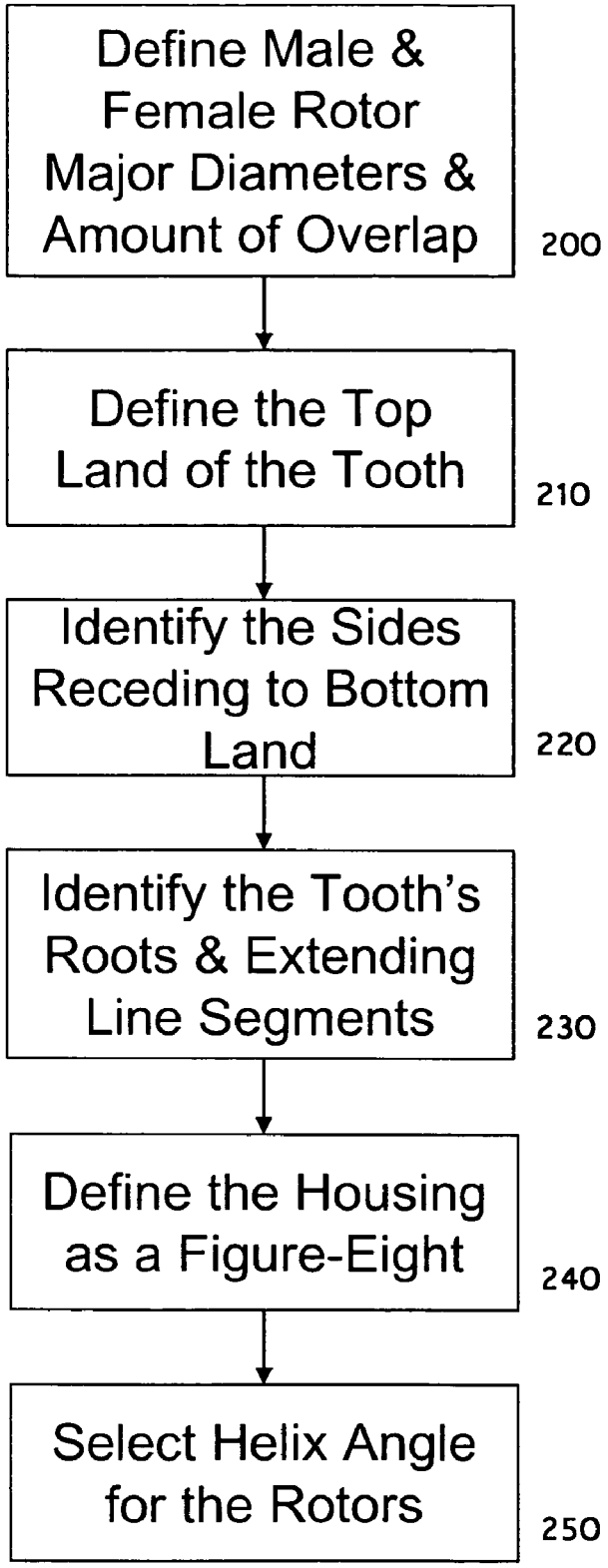
FIG. 17 shows a flow chart of the design process for making the families of screw rotor devices according to the present invention.

The design process of the present invention is schematically set forth in the illustrations of FIGS. 14–16, and is set forth as a flowchart in FIG. 17. To get a visual picture of the process, FIG. 14 is particularly helpful to understand the inventive design process. Generally, the top land's trailing edge 1 and leading edge 2 respectively define the helical groove's trailing side 1' and the leading side 2' as the helical thread intermeshes with the helical groove. To eliminate the blow-hole gap on the front side of the screw rotor device, the trailing ridge of the groove and the trailing edge of the thread intersect at the front cusp 130, i.e. within the sealing tolerance defined for the rotors. Similarly, to eliminate the blow-hole gap on the back side of the screw rotor device, the leading ridge of the groove and the leading edge of the thread intersect at the back cusp 132. Finally, the groove's trailing ridge 3 and leading ridge 4 respectively define the thread's trailing root portion 3' and leading root portion 4', and the intermediate points lining the groove's bottom side 3''' and top side 4''' respectively define intermediate points lining the thread's bottom face and top face.

In eliminating the blow-hole gap on the front side and the back side of the housing, it will be appreciated that the thread profile has discontinuities between its top land and its top and bottom faces, i.e. trailing and leading faces, respectively, for the compressor or pump type of application. The leading edge discontinuity is located at the leading edge point where the leading line and the major diameter arc intersect. The trailing edge discontinuity is located at the trailing edge point where the trailing line and the major diameter arc intersect. According to this visual image of the design process, it will be appreciated that the thread's cross-sectional profile lines between the top land and the root can be formed from any type of line, including straight lines, concave lines, convex lines, arcs, involutes, inverse-involutes, parabolas, hyperbolas, cycloids, trochoids, epicycloids, epitrochoids, hypocycloids, hypotrochoids, continuous straight lines and arcuate lines, and any combination thereof in piecewise-continuous lines.

FIGS. 15 and 16 illustrate other thread and groove designs that can form entire families of screw rotor profiles. FIG. 15 takes the groove's trailing line and leading line from FIG. 14 and turns them into a thread's leading line and trailing line, i.e. reversing them, to show that the same design process can be used in reverse and will result in groove sides that are a reverse of the groove sides in FIG. 14. FIG. 16 shows in phantom lines the groove's leading line and trailing line from the initial stage of the design, i.e. before using the intermediate points lining the groove's bottom side 3" and top side 4" respectively to define intermediate points lining the thread's bottom face 3" and top face 4". After performing this final step, the solid lines show that the thread's leading lines and trailing lines, i.e. respectively corresponding with the groove's leading lines and trailing lines, become more arcuate. However, for machining purposes, it is still possible to change the design to a set of straight line segments, or even other arcuate sections, while still remaining within the design tolerances for the particular application and family of rotors. FIG. 16 also shows how families of curves can also be based on different minor diameters of the male and female rotors, even when the major diameters remain constant.

The design process of the present invention is now described with reference to the flowchart in FIG. 17:

(a) define the male and female rotor major diameters and their amount of overlapping (200), i.e., define a pair of intersecting major circles that each have a center and a major diameter such that each one of the circles encompasses only its own center and the centers are spaced apart less than a sum of one half of the major diameters;

(b) define the top land of the tooth on one of the intersecting major circles (210);

(c) identify the pair of sides radially receding from the other circle to a bottom land (220); the sides are defined by the top land's path when the circles rotate in phase with each other by equal angular amounts, and the sides include a pair of intermediate line segments receding from a pair of circumferential ridges to the bottom land;

(d) identify the tooth's pair of root sections; the root sections are respectively defined by the ridges' paths when said the circles rotate in phase with each other by equal angular amounts and identify the tooth's pair of radially extending line segments (230); the radially extending line segments are defined by the groove's intermediate line segments' paths when the circles rotate in phase with each other by equal angular amounts.

Given these design conditions, it will be appreciated that the threads and grooves can be designed according to the present invention such that they have minimal backlash. In particular, many designs for screw rotors have pressure angles as high as 30° which results in a significant amount of backlash. In comparison, the present invention allows designers to create entire families of screw rotors with minimal backlash, such as with pressure angles less than half of 30°, including families with 0° pressure angle and no backlash.

It will also be appreciated that, in completing the screw rotor system design, the interior sides of the housing are generally defined in the shape of a figure-eight in close tolerance with the circles 240. As illustrated in FIG. 9, the inlet and outlet can be in the shape of a wedge shape. In particular, inlet can be a trapezoid, and the outlet can be a triangular side port, i.e. generally V-shaped. As discussed with respect to the embodiments discussed with regard to FIGS. 1–7, the outlet port can be a circumferential end port or a V-shaped circumferential end port. Similarly, the inlet port can be a circumferential end port or a W-shaped circumferential end port.

Of course, to create the third dimension for the screw rotors, at least one helix angle needs to be selected 250. As discussed above, the helix angle can be varied along the length of the rotors, thereby resulting in a variable pitch screw rotor compressor. Also, the major and minor diameters can be varied along the length of the rotors, thereby resulting in a tapered screw rotor compressor.

As yet more detail into the design process, the first rotor major circle is defined. The first rotor major circle has a first major diameter. The second rotor major circle is also defined such that it intersects with the first rotor major circle at a pair of intersection points. The second rotor major circle has a second major diameter, and less than one half of the second major diameter extends into the first rotor major circle. Less than one half of the first major diameter extends into the second rotor major circle, and the second rotor major circle shares a single tangential point with a first rotor minor circle centered within the first rotor major circle. The first rotor major circle shares another single tangential point with a second rotor minor circle centered within the second rotor major circle.

A first point is now selected on the first rotor major circle, and the point defines a first line segment receding radially inward from the second rotor major point to the second rotor minor point. In particular, the first line segment is defined by the path of the first point as it progresses from the second rotor major circle to the second rotor minor circle when the first rotor major circle and the second rotor major circle rotate in phase with each other by equal angular amounts. Similarly, a second point on the first rotor major circle and circumferentially spaced from the first point is selected, and the point defines a second line segment receding radially inward from a circumferentially-spaced second rotor major point to a circumferentially-spaced second rotor minor point. The second line segment is defined by the path of the second point as it progresses from the second rotor major circle to the second rotor minor circle when the first rotor major circle and the second rotor major circle rotate in phase with each other by equal angular amounts. Additionally, the circumferentially-spaced second rotor major point and second rotor minor point are circumferentially spaced from the second rotor major point the second rotor minor point, respectively.

A pair of first rotor root line segments that extend from the first rotor minor circle to a pair of intermediate points are now identified. One intermediate point is situated between the first rotor minor circle and the first point on the first rotor major circle and the other intermediate point is situated between the first rotor minor circle and the second point on the first rotor major circle. The intermediate points are circumferentially spaced from each other, and the first rotor root line segments are defined by the paths of the second rotor major point and the circumferentially-spaced second rotor major point when the first rotor major circle and the second rotor major circle rotate in phase with each other by equal angular amounts. Finally, to complete the profile for the thread, it is preferable to use a pair of circumferentially-spaced first rotor line segments that respectively extend between the pair of first rotor root line segments and the first point and the second point on the first rotor major circle.

In designing profiles of the screw rotor devices, it will be appreciated that the top land of the thread is preferably an arc rather than merely being a point on the major diameter of the male rotor. This preference can be rather important because a point may tend to cause the Bernoulli effect, causing the top land of the thread and the bottom land of the groove to act as a converging-diverging nozzle. Due to pressure differentials, such an effect could even result in supersonic flow through such a nozzle, producing shock waves which are non-adiabatic and increase the entropy in the flow, thereby increasing the flow temperature and reducing the thermodynamic efficiency.

Figure 12:
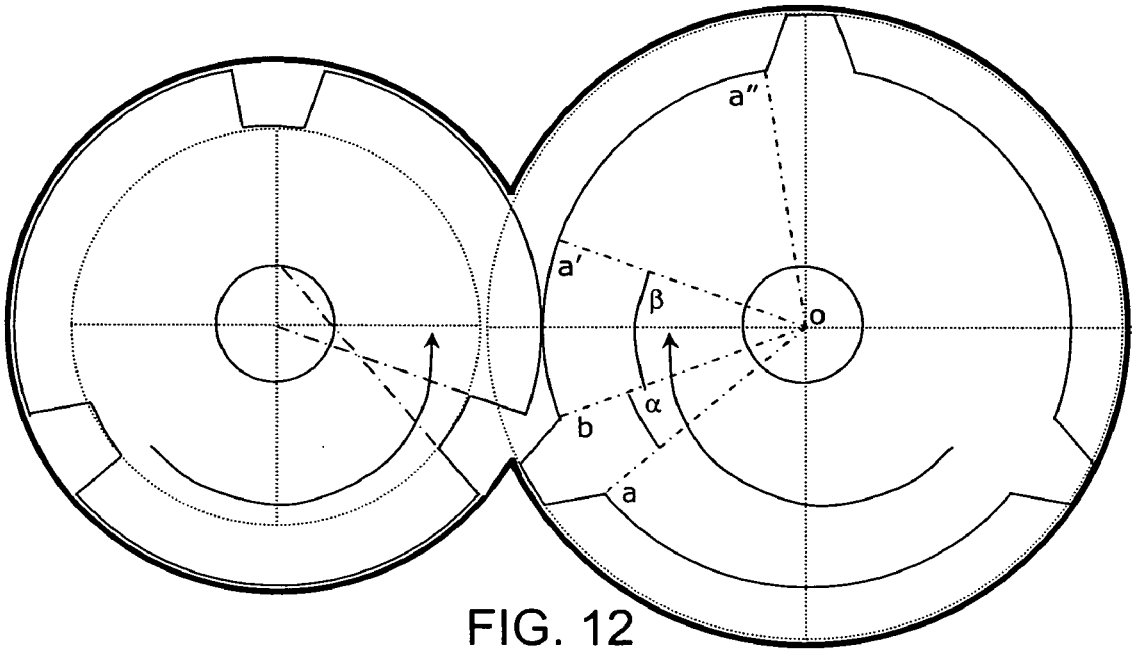
FIGS. 12 and 12A–12F show a cross-sectional view of the screw rotor device according to yet another embodiment of the present invention along with a series of cross-sectional views of the screw rotor device as the male and female rotors intermesh and seal.
Figure 12A:
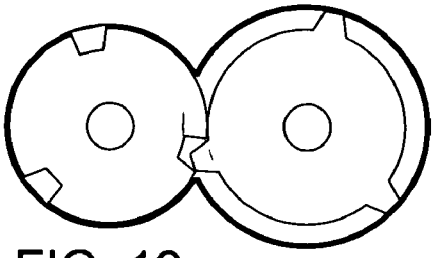
Figure 12B:
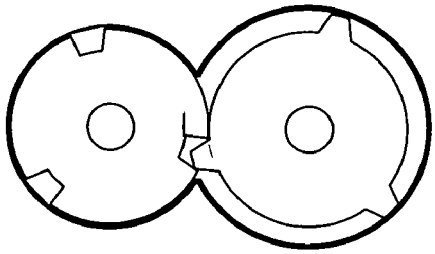

From a close examination of the embodiments of the present invention, it will be apparent that, in the embodiments illustrated in FIGS. 10–12, the major diameter of the female rotor is approximately equal to the minor diameter of the male rotor, whereas in the embodiments illustrated in FIGS. 1–7, the major diameter of the female rotor is not equal to the minor diameter of the male rotor. By examining the process for designing all of these rotor embodiments, as discussed above with reference to the illustrations in FIGS. 14–16 and the flow chart in FIG. 17, it will be appreciated that all of the embodiments are merely different rotor families designed according to the present invention. Therefore, whether these diameters are equal or different may be more important based on the application in which the screw rotor system 10 will be used rather than any mere design choice.

This selection could be important to particular applications because when the female rotor major diameter seals with the male rotor minor diameter (ᗰ), the rotors may be so close as to cause friction therebetween, and rolling friction (same diameters) is less than sliding friction (different diameters). By reducing the friction in the screw rotor system, the steady state temperature of the rotors and the flow traveling through the rotors can be kept lower than when there is the higher friction of sliding friction between the rotors. This could be important in a refrigeration application or some other cooling application in which air or another working fluid is being run through one or more screw rotors to cool the working fluid.

Figure 18:
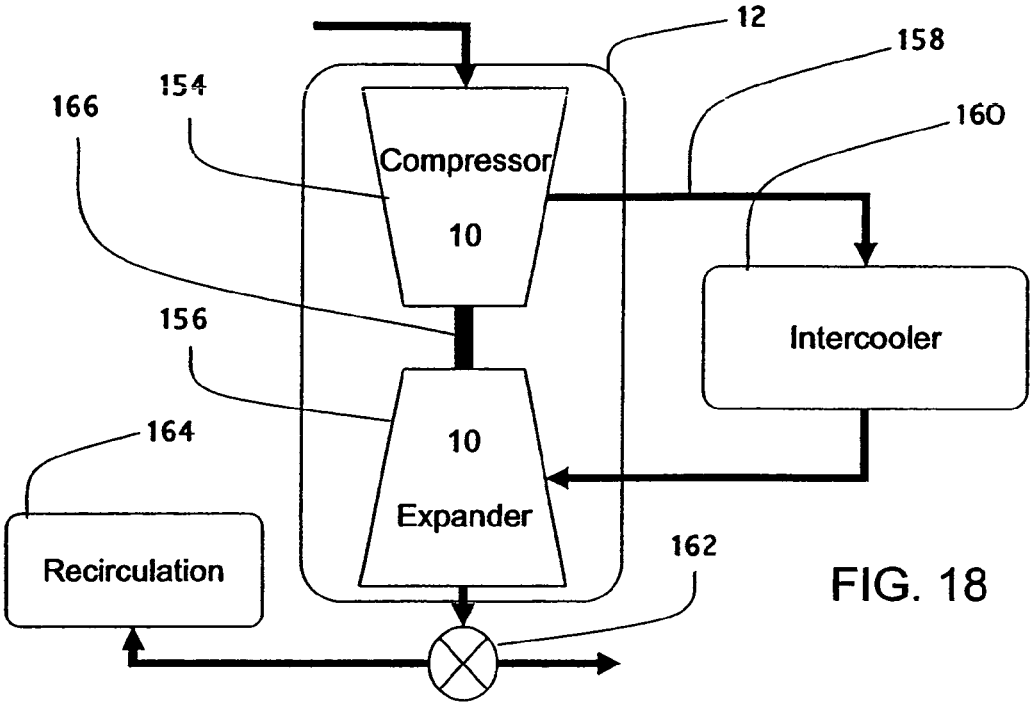
FIG. 18 shows the screw rotor device in a refrigeration/cooling cycle application.

An example of an application that cools the working fluid is illustrated in FIG. 18, in which one screw rotor device 10 operates as a compressor 154 for the incoming working fluid and the other screw rotor device 10 operates as an expander 156. After exiting the outlet port of the compressor, the working fluid is preferably passed through a fluid conduit 158 to an intercooler 160 or other type of thermodynamic processor, such as a heat exchanger, and then the working fluid enters the expander through its inlet section. The working fluid may also be selectively recirculated by a control valve 162 through a recirculation path 164. Additionally, the compressor and expander can be mechanically linked through a drive shaft 166, which could also include gears.

Such a mechanical linkage between the devices 10, 10, could reduce the steady-state power requirement of the compressor by more than 50%. In particular, the work that is extracted out of the expander can be passed back to the compressor through the mechanical linkage. Therefore, with an expander operating at or above a thermodynamic efficiency of 85%, most of the expansion energy is available to help run the compressor. It will be appreciated that when the compressor and the expander are linked together in this manner, it is possible for the units to be integrated into a single housing 12. Of course, it will also be appreciated that multiple stages of compressors and/or expanders can be used to super-cool certain working fluids.

Figure 19:
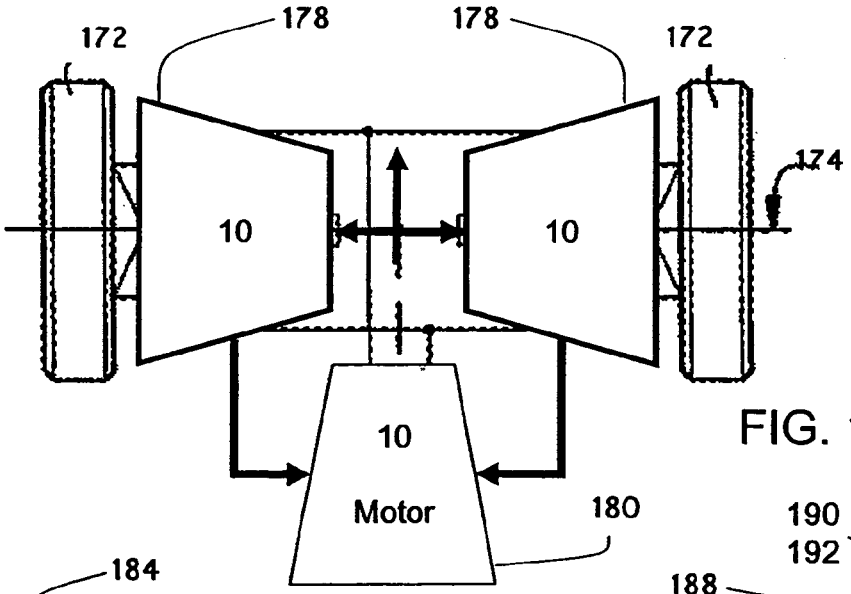
FIG. 19 shows the screw rotor device in a hydrostatic drive application.

The screw rotor system can also be used in many other applications. For example, the screw rotors can be used in many types of hydrostatic power systems 168 and hydrodynamic power systems 170. A hydrostatic power system is discussed with reference to FIG. 19, followed by a couple embodiments of hydrodynamic power systems, which are discussed with reference to FIGS. 20 and 21. Hydrostatic drive transmission systems are generally known for independently powering vehicle wheels 172 about an axle 174, offering infinitely variable speed control, a smooth transition from forward to reverse, precise steering control and hydrostatic braking. In some applications, the hydrostatic drive can also function as the primary braking system. Generally, hydrostatic drive systems are closed loop systems which receive their power supply from a pressurized fluid source 176. In the present embodiment, the screw rotor system 10 according to the present invention could be used for the hydrostatic drive motors 178 as well as the engine 180 that creates the pressurized fluid source.

Figure 20:
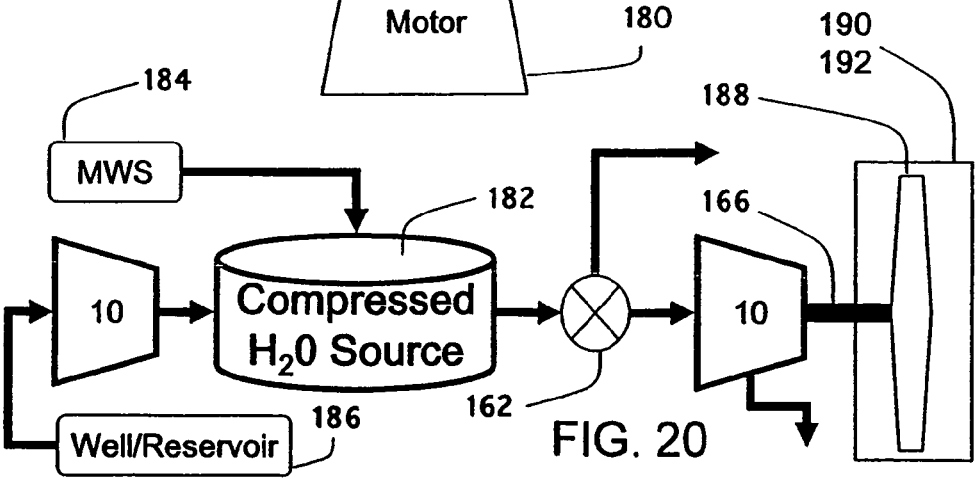
FIG. 20 shows the screw rotor device in a hydrodynamic drive application.
Figure 21:
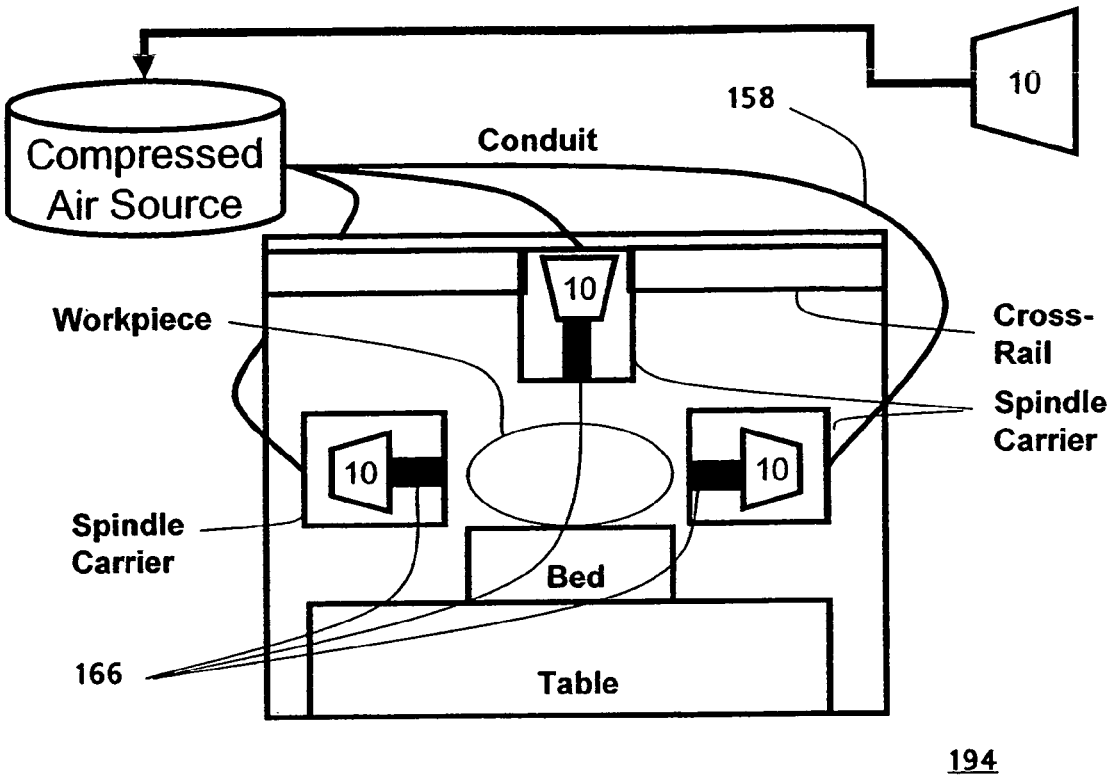
FIG. 21 shows the screw rotor device in a compressor application and in a power drive application.
Figure 22:
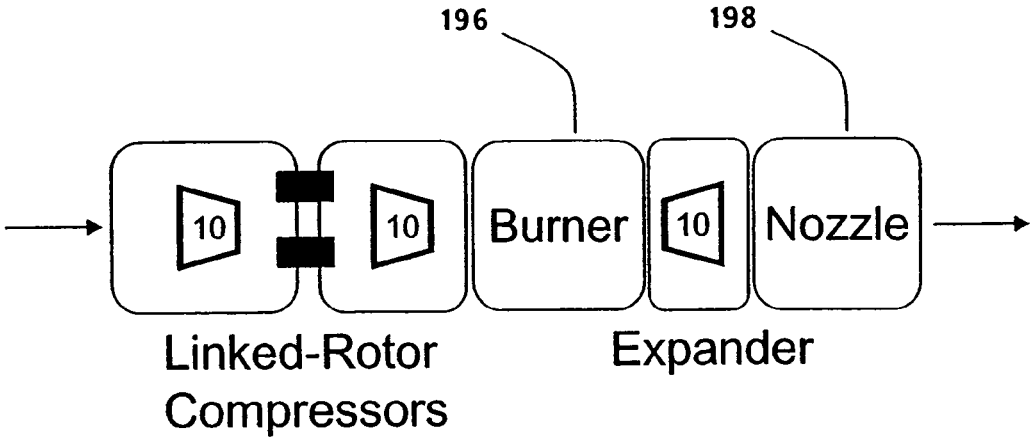
FIG. 22 shows the screw rotor device in a gas turbine engine application.

In comparison to the hydrostatic drive, hydrodynamic drive converts into work as much of the energy in the compressed working fluid as possible and then dispels the spent working fluid. A couple of examples generally illustrated by FIG. 20 show how pressurized water 182 can be used as the working fluid. It will be appreciated that this pressurized water can come from a municipal water supply 184 through a pipeline system or can be pumped directly from a well 186 or can be stored in a local reservoir with the machine being powered. In the hydrodynamic application, the water powers the screw rotor system 10 which is linked through a drive shaft 166, which may include gears, to the working device 188. As the water passes through the screw rotor device, the rotors extract the energy and dump the low pressure water out of the housing. A control valve 162 is likely to be required for many applications, such as those applications that are run intermittently whereas perhaps only a safety shut-off valve may only used for a continuously operating system.

One particular use that is within the scope of the present invention is the use of blades and other tools as the working device. For example, the blades could be for a garbage crusher or for a lawn mower. In the case where the blade is for a garbage crusher or garbage chopper (drain/blade housing 190 shown), the high pressure water (working fluid) powers the crusher and the low pressure water (spent fluid) is dispelled into the drain or other receptacle where the garbage is being crushed and/or chopped. For a kitchen sink application, the high pressure water preferably comes from the standard cold water supply of the sink, and it will be appreciated that the low pressure water that is dispelled into the drain would be useful for washing the garbage down the drain while the high pressure water is used to power the crusher/chopper. Similarly, for a hydrodynamic lawn mower (blade housing 192 shown), the high pressure water (working fluid) powers the blades and the low pressure water (spent fluid) is dispelled onto the portion of the lawn that has just been cut. For the hydrodynamic lawn mower, the high pressure water preferably comes from a standard outside faucet, although for larger powered mowers, a reservoir tank could be used to haul the water and a screw rotor compressor could be used to create the pressurized water source. Once the water's pressure is spent to power the blade, the water can be dumped onto the lawn.

Another dynamic application is the use of the screw rotor devices in a milling machine 194 or other such tooling equipment. In this case, the working fluid is pressurized air. Therefore, to extract the energy from the air and thereby power the tool, the air is expanded within the screw rotor system 10. As the air expands, its temperature drops. Therefore, during spring and summer months, the colder expanded air can be used to cool the machining facility, and during the fall and winter months, the colder air can be dumped through a valve to the outside.

In the last application particularly discussed for the present invention, a gas turbine engine includes linked-rotor compressors 154–166–154, a burner section 196, an expander 156, and a nozzle 198. The linked-rotor compressors are multiple stages of the compressors 10, 10 which are used to super-compress the air before it is burned and then expanded.

Figure 12C:
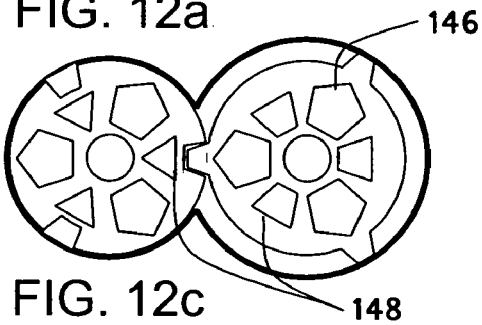
Figure 12D:
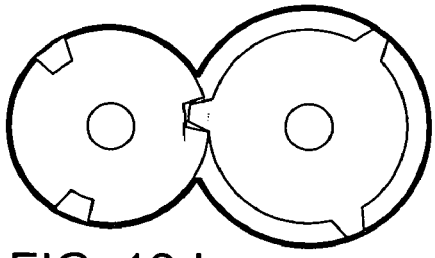
Figure 12E:
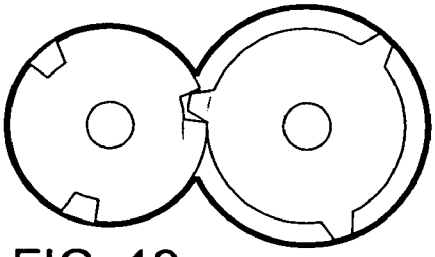
Figure 12F:
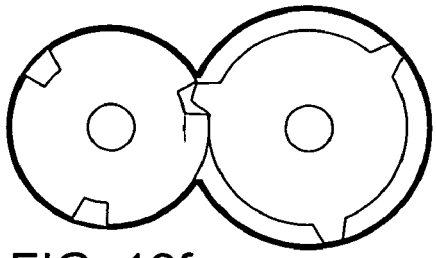
Figure 13A:
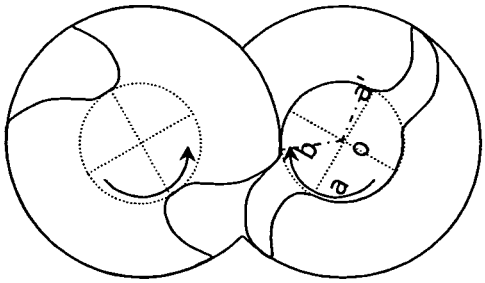
FIGS. 13A–13H show a series of cross-sectional views of the screw rotor device according to the embodiment of the invention in FIGS. 7A and 7B as the male and female rotors intermesh and seal.
Figure 13B:
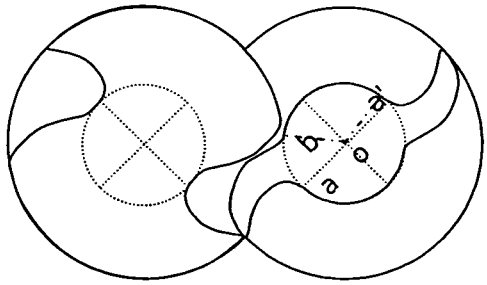
Figure 13C:
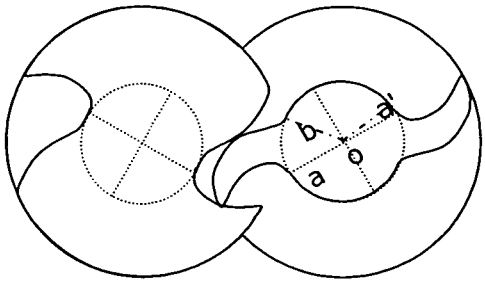
Figure 13D:
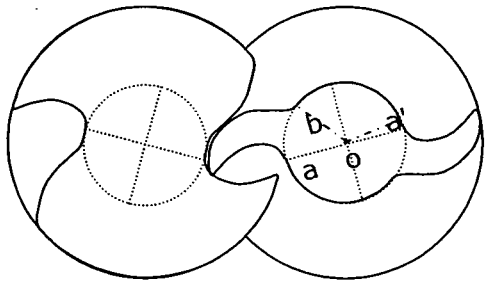
Figure 13E:
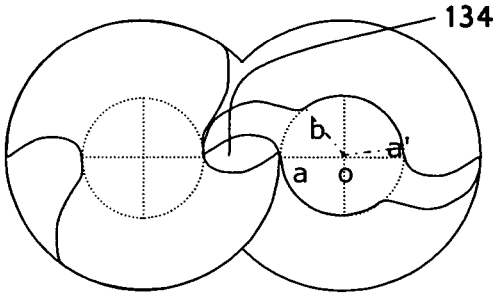
Figure 13F:
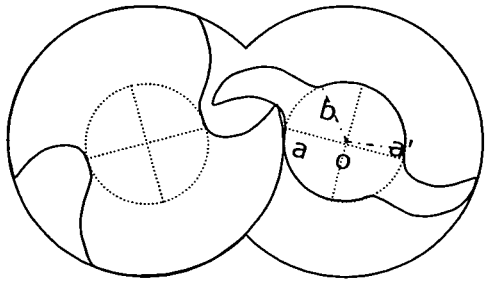
Figure 13G:
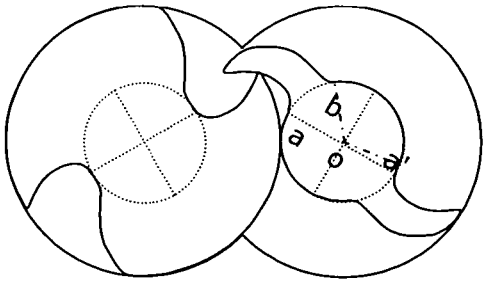
Figure 13H:
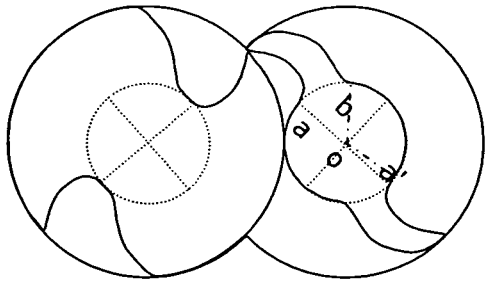

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, although the preferred embodiments of the present invention describes rotors having substantially parallel axes, the axes do not necessarily need to be parallel. Additionally, the method for designing screw rotor profiles according to the present invention is not limited to any particular coordinate system. For example, a Cartesian coordinate system, i.e., rectangular (x, y, z), or an angular coordinate system, i.e., cylindrical (r, Φ, x) could be used to define the profiles. Other coordinate systems may also be used, such as a polar coordinate system, although it will be appreciated that some coordinate systems may unnecessarily add complexity to the design process. Additionally, the several applications discussed herein are illustrative of the wide range of applications where the present invention can be useful. In particular, it will be appreciated that for the internal combustion engine application of the screw rotor system 10, a fuel inlet 108 would be used to deliver the fuel into one of the spaces 39, 41. It will also be appreciated that, for this embodiment, the flow would likely be moving in the opposite direction from that which is illustrated in FIG. 9, and that the zero-gap fluid metering application of the screw rotor system 10 would not have such a fuel inlet, but such a port or inlet could be useful for a pressure gauge and/or a temperature gauge for measuring the operating state of the device. Additionally, as illustrated in FIG. 12C, the inertial energy of the rotors can be changed by providing cut-outs 146 along the length of the rotors, and one or more of these cut-outs may also be used as pathways 148 for a non-working fluid to flow through the rotors and cool the screw rotor system. Of course, it will also be appreciated that multiple stages of compressors and/or expanders can be used to super-cool certain working fluids. Finally, in addition to "stacking" the screw rotors, i.e., mechanically linking the rotors of multiple screw rotor devices, the thread and groove may have a variable pitch along the axial length of the rotors and the rotors may be tapered. Thus, the breadth and scope of the present invention should not be limited by any of the above-described exemplary embodiments, but should be defined only in accordance with the following claims appended hereto and their equivalents.

What is claimed is:

1. A screw rotor device for positive displacement of a working fluid, comprising:

a female rotor comprising a major diameter and a helical groove receding from said major diameter, said helical groove comprising a bottom land situated between a leading side and a trailing side, said leading side and said trailing side respectively comprising a leading ridge and a trailing ridge at said major diameter;

a male rotor comprising a minor diameter and a helical thread extending from said minor diameter and rotatably intermeshing in phase with said helical groove, said helical thread comprising a top land situated between a leading face and a trailing face, said leading face and said trailing face comprising a leading edge and a trailing edge, respectively, wherein said top land is in a first sealing relationship with said bottom land, wherein said trailing face is in a second sealing relationship with said trailing ridge, wherein said trailing edge is in a third sealing relationship with said trailing side, and wherein a cross-sectional profile of said helical thread is comprised of a top land line between a leading line and a trailing line, said leading line and said trailing line being selected from a group consisting of a concave line, a straight line, a convex line, and any combination thereof; and a housing enclosing said female rotor and said male rotor, said housing comprising a front side, a back side, a first end, a second end, an inlet port, an outlet port, and a pair of cylindrical bores extending between said first end and said second end along a length of said front side and said back side, said pair of cylindrical bores comprising a front cusp extending along said length of said front side and a back cusp extending along said length of said back side of said housing, wherein said third sealing relationship extends continuously along said trailing side of said female rotor from said front cusp to said bottom land, said front cusp being in close tolerance with said major diameter of said female rotor.

2. The screw rotor device according to claim 1, wherein said leading face is in a fourth sealing relationship with said leading ridge, wherein said leading edge is in a fifth sealing relationship with said leading side, wherein said trailing ridge and said trailing edge are in a sixth sealing relationship with each other and with said front cusp, and wherein said leading ridge and said leading edge are in a seventh sealing relationship with each other and with said back cusp.

3. The screw rotor device according to claim 2, wherein said major diameter of said female rotor is in an eighth sealing relationship with one of said pair of cylindrical bores, wherein said top land of said thread is in a ninth sealing relationship with another of said pair of cylindrical bores, and wherein said major diameter of said female rotor is in a tenth sealing relationship with said minor diameter of said male rotor, and wherein said major diameter of said female rotor is approximately equal to said minor diameter of said male rotor.

4. The screw rotor device according to claim 3, wherein said first sealing relationship comprises a center, intermeshing sealing area defined by geometries of said top land and said bottom land, wherein said second sealing relationship comprises a front, outer sealing line defined by geometries of said trailing face and said trailing ridge, wherein said third sealing relationship comprises a front, inner sealing line defined by geometries of said trailing edge and said trailing side, wherein said fourth sealing relationship comprises a back, outer sealing line defined by geometries of said leading face and said leading ridge, wherein said fifth sealing relationship comprises a back, inner sealing line defined by geometries of said leading edge and said leading side, wherein said front, outer sealing line and said front, inner sealing line define boundaries of a front, intermeshing sealing area between said trailing face and said trailing side and intersect at a common front sealing point according to said sixth sealing relationship defined by intersection of trailing edge, trailing ridge and front cusp, wherein said back, outer sealing line and said back, inner sealing line define boundaries of a back, intermeshing sealing area between said leading face and said leading side and intersect at a common back sealing point according to said seventh sealing relationship defined by intersection of leading edge, leading ridge and back cusp, wherein said eighth sealing relationship comprises a first peripheral sealing area defined by geometries of female rotor major diameter and said cylindrical bores, wherein said ninth sealing relationship comprises a second peripheral sealing area defined by geometries of said top land and said cylindrical bores, and wherein said tenth sealing relationship comprises a center, non-meshing sealing area defined by geometries of said female rotor major diameter and said male rotor minor diameter.

5. The screw rotor device according to claim 3, wherein said female rotor and said male rotor further comprise a plurality of grooves and threads, said plurality of grooves and threads being identical in number and intermeshing in phase with each other, wherein said cross-sectional profile of said male rotor further comprises a tooth, an adjacent tooth, and a toothless sector between said tooth and said adjacent tooth, said tooth being subtended by a first arc angle and said toothless sector comprising a second arc angle proportional to said first arc angle by a phase-offset multiplier, wherein said phase-offset multiplier is at least one.

6. A screw rotor device for positive displacement of a working fluid, comprising:

a female rotor comprising a major diameter and a helical groove receding from said major diameter, said helical groove comprising a bottom land situated between a leading side and a trailing side, said leading side and said trailing side respectively comprising a leading ridge and a trailing ridge at said major diameter; and a male rotor comprising a minor diameter and a helical thread extending from said minor diameter and rotatably intermeshing in phase with said helical groove, said helical thread comprising a top land situated between a leading face and a trailing face, said leading face and said trailing face comprising a leading edge and a trailing edge, respectively, wherein said top land is in a first sealing relationship with said bottom land, wherein said trailing face is in a second sealing relationship with said trailing ridge, wherein said trailing edge is in a third sealing relationship with said trailing side, wherein said leading face is in a fourth sealing relationship with said leading ridge, wherein said leading edge is in a fifth sealing relationship with said leading side; and a housing enclosing said female rotor and said male rotor, said housing comprising a front side, a back side, a first end, a second end, an inlet port, an outlet port, and a pair of cylindrical bores extending between said first end and said second end along a length of said front side and said back side, said pair of cylindrical bores comprising a front cusp extending along said length of said front side and a back cusp extending along said length of said back side of said housing, wherein said third sealing relationship and said fifth sealing relationship are connected through said first sealing relationship at said bottom land and respectively extend continuously to said bottom land along said trailing side and said leading side from said front cusp and said back cusp, said front cusp and said back cusp being in close tolerance with said major diameter of said female rotor.

7. The screw rotor device according to claim 6, wherein said trailing ridge and said trailing edge are in a sixth sealing relationship with each other and with said front cusp, wherein said leading ridge and said leading edge are in a seventh sealing relationship with each other and with said back cusp, wherein said major diameter of said female rotor is in an eighth sealing relationship with one of said pair of cylindrical bores, wherein said top land of said thread is in a ninth sealing relationship with another of said pair of cylindrical bores, and wherein said female rotor major diameter is in a tenth sealing relationship with said male rotor minor diameter.

8. The screw rotor device according to claim 7, wherein said first sealing relationship comprises a center, intermeshing sealing area defined by geometries of said top land and said bottom land, wherein said second sealing relationship comprises a front, outer sealing line defined by geometries of said trailing face and said trailing ridge, wherein said third sealing relationship comprises a front, inner sealing line defined by geometries of said trailing edge and said trailing side, wherein said fourth sealing relationship comprises a back, outer sealing line defined by geometries of said leading face and said leading ridge, wherein said fifth sealing relationship comprises a back, inner sealing line defined by geometries of said leading edge and said leading side, wherein said front, outer sealing line and said front, inner sealing line define boundaries of a front, intermeshing sealing area between said trailing face and said trailing side and intersect at a common front sealing point according to said sixth sealing relationship defined by intersection of trailing edge, trailing ridge and front cusp, wherein said back, outer sealing line and said back, inner sealing line define boundaries of a back, intermeshing sealing area between said leading face and said leading side and intersect at a common back sealing point according to said seventh sealing relationship defined by intersection of leading edge, leading ridge and back cusp, wherein said eighth sealing relationship comprises a first peripheral sealing area defined by geometries of female rotor major diameter and said cylindrical bores, wherein said ninth sealing relationship comprises a second peripheral sealing area defined by geometries of said top land and said cylindrical bores, and wherein said tenth sealing relationship comprises a center, non-meshing sealing area defined by geometries of said female rotor major diameter and said male rotor minor diameter.

9. The screw rotor device according to claim 7, wherein said female rotor and said male rotor further comprise a plurality of grooves and threads, said plurality of grooves and threads being identical in number and intermeshing in phase with each other, and wherein a cross-sectional profile of said male rotor comprises a tooth, an adjacent tooth, and a toothless sector between said tooth and said adjacent tooth, said tooth being subtended by a first arc angle and said toothless sector comprising a second arc angle proportional to said first arc angle by a phase-offset multiplier.

10. The screw rotor device according to claim 7, further comprising a valve in communication with said outlet port, wherein said helical thread intermeshes with said helical groove in a double-sided sealing relationship, said double-sided sealing relationship defined by said first sealing relationship, said second sealing relationship, said third sealing relationship, said fourth sealing relationship, and said fifth sealing relationship, wherein a leak pathway is not provided through said double-sided sealing relationship, said leak pathway being any stream tube between said male rotor and said female rotor, extending from said front side to said back side and formed by set of continuous gaps with an effective diameter exceeding an order of magnitude greater than a sealing tolerance, wherein said helical thread intermeshes with said helical groove on said front side in close proximity to said front cusp such that a front blow hole is not provided between said helical thread, said helical groove and said front cusp, and wherein said helical thread intermeshes with said helical groove on said back side in close proximity to said back cusp wherein a back blow hole is not provided between said helical thread, said helical groove and said back cusp.

11. A screw rotor product for positive displacement of a working fluid, comprising:

a housing comprising a first end, a second end, an inlet port, an outlet port, and a pair of cylindrical bores extending between said first end and said second end, said pair of cylindrical bores comprising a front cusp extending along a length of a front side of said housing and a back cusp extending along a length of a back side of said housing;

a female rotor comprising a major diameter and a helical groove receding from said major diameter, said helical groove comprising a bottom land situated between a leading side and a trailing side, said female rotor being rotatably mounted in said housing with said major diameter in close tolerance with one of said pair of cylindrical bores to form a first peripheral sealing area; and a male rotor comprising a minor diameter and a helical thread extending from said minor diameter, said male rotor rotatably mounted in said housing, said helical thread comprising a top land situated between a leading face and a trailing face, a cross-sectional profile of said helical thread respectively comprising a top land line situated between a leading line and a trailing line, said leading line and said trailing line being selected from a group consisting of a concave line, a straight line, a convex line, and any combination thereof, said top land being in close tolerance with another one of said pair of cylindrical bores to form a second peripheral sealing area, said helical thread intermeshing in phase and in close tolerance with said helical groove to form an intermeshing sealing area, said intermeshing sealing area extending continuously from a back region at a back intersection between said leading face, said leading side, and said back cusp to a front region at a front intersection between said trailing face, said trailing side and said front cusp.

12. The screw rotor device according to claim 11, wherein said back intersection does not include a back blow hole between said helical thread, said helical groove and said back cusp and wherein said front intersection does not include a front blow hole between said helical thread, said helical groove and said front cusp.

13. The screw rotor device according to claim 11, wherein said intermeshing sealing area further comprises a center sealing area between said top land and said bottom land.

14. The screw rotor device according to claim 11, wherein said leading face and said trailing face further comprise a leading edge and a trailing edge, respectively, and wherein said intermeshing sealing area further comprises a leading seal area between said leading edge and said leading side and a trailing seal area between said trailing edge and said trailing side.

15. The screw rotor device according to claim 14, wherein said leading seal area further comprises a leading axial seal between said leading face of said thread and said leading side of said groove.

16. The screw rotor device according to claim 15, wherein said leading side of said groove further comprises a leading ridge at said major diameter of said female rotor and said leading axial seal further comprises a seal between said leading ridge and said leading face.

17. The screw rotor device according to claim 14, wherein said trailing seal area further comprises a trailing axial seal between said trailing face of said thread and said trailing side of said groove, said trailing side of said groove further comprises a trailing ridge at said major diameter of said female rotor, and said trailing axial seal comprises a seal between said trailing ridge and said trailing face.

18. The screw rotor device according to claim 11, wherein said intermeshing sealing area further comprises a leading seal area, a trailing seal area, and a center sealing area connecting said leading seal area to said trailing seal area, wherein said leading face and said trailing face further comprise a leading edge and a trailing edge, respectively, wherein said leading side and said trailing side further comprise a leading ridge and a trailing ridge, respectively, wherein said center sealing area is formed between said top land and said bottom land, wherein said leading seal area is formed between said leading side and said leading face at a first region defined by said leading edge intersecting with said leading side, at a second region defined by said leading ridge intersecting with said leading face, and at a third region extending between said first region and said second region, and wherein said trailing seal area is formed between said trailing face and said trailing side.

19. The screw rotor device according to claim 18, wherein said trailing seal area comprises a first trailing region defined by said trailing edge intersecting said trailing side, a second trailing region defined by said leading ridge intersecting with said leading face, and a third trailing region extending between said first trailing region and said second trailing region.

20. The screw rotor device according to claim 18, wherein said female rotor and said male rotor further comprise a plurality of grooves and threads, respectively, said plurality of grooves and threads being identical in number and intermeshing in phase with each other, wherein a cross-sectional profile of said male rotor comprises a tooth, an adjacent tooth, and a toothless sector between said tooth and said adjacent tooth, said tooth being subtended by a first arc angle and said toothless sector comprising a second arc angle proportional to said first arc angle by a phase-offset multiplier.

21. The screw rotor device according to claim 11, wherein said female rotor and said male rotor each further comprise an axis of rotation centrally located within one of said pair of cylindrical bores, wherein said major diameter of said female rotor rotates in close tolerance to said minor diameter of said male rotor to form a center, non-meshing sealing area therebetween, and wherein the positive displacement of the working fluid between said inlet port and said outlet port of said housing is produced by said female rotor and said male rotor with a thermodynamic efficiency of at least 85%.

22. The screw rotor device of claim 21, further comprising a valve in communication with said outlet port, wherein said center, non-meshing sealing area and said intermeshing sealing area are joined to form a continuous seal extending from said first end of said housing to said second end of said housing and wherein the positive displacement of the working fluid between said inlet port and said outlet port of said housing is produced by said female rotor and said male rotor with a thermodynamic efficiency of at least 90%.

23. The screw rotor device according to claim 21, wherein said top land line is comprised of an arc and wherein said geometrical line pairs are asymmetric about a center point of said arc.

24. The screw rotor device according to claim 21, wherein a cross-sectional profile of said helical groove comprises a bottom land line situated between a pair of lines selected from a group consisting of a concave line, a straight line, a convex line, and any combination thereof.

25. The screw rotor device according to claim 24, wherein one of said pair of lines is radially aligned with said axis of rotation for said female rotor.

26. The screw rotor device according to claim 21, wherein said female rotor and said male rotor further comprise a plurality of grooves and threads, respectively, said plurality of grooves and threads being identical in number and intermeshing in phase and in close tolerances with each other.

27. The screw rotor device according to claim 26, wherein a cross-sectional profile of said male rotor comprises a tooth, an adjacent tooth, and a toothless sector between said tooth and said adjacent tooth, said tooth being subtended by a first arc angle and said toothless sector comprising a second arc angle proportional to said first arc angle by a phase-offset multiplier.

28. The screw rotor device according to claim 26, wherein said close tolerances between said grooves and said threads are within a same order of magnitude as at least one of said close tolerance between said female rotor and said housing and said close tolerance between said male rotor and said housing.

29. The screw rotor device according to claim 26, wherein said close tolerances between said grooves and said threads is no greater than at least one of said close tolerance between said female rotor and said housing and said close tolerance between said male rotor and said housing.

30. The screw rotor device according to claim 26, further comprising a recirculation path for the working fluid from said outlet port to said inlet port and external to the positive displacement of the working fluid between said inlet port and said outlet port within said housing.

31. A screw rotor system for positive displacement of a working fluid, comprising:

a housing comprising a first end, a second end, an inlet port, an outlet port, and a pair of cylindrical bores extending between said first end and said second end, said pair of cylindrical bores comprising a first cusp extending along a length of a first side of said housing and a second cusp extending along a length of a second side of said housing;

a female rotor comprising a major diameter and a helical groove receding from said major diameter, said helical groove comprising a bottom land situated between a leading side and a trailing side, said leading side and said trailing side comprising a leading ridge and a trailing ridge at said major diameter, said major diameter being in a first sealing relationship with one of said pair of cylindrical bores; and a male rotor comprising a minor diameter and a helical thread extending from said minor diameter and rotatably intermeshing in phase with said helical groove within said housing, said minor diameter being in a second sealing relationship with said major diameter of said female rotor, said helical thread comprising a top land in a third sealing relationship with another of said pair of cylindrical bores, wherein said top land is also in a fourth sealing relationship with said bottom land, said top land being situated between a leading face and a trailing face, said trailing face being in a fifth sealing relationship with said trailing ridge, said trailing face further comprising a trailing edge in a sixth sealing relationship with said trailing side, wherein said trailing ridge and said trailing edge are in a seventh sealing relationship with each other and with said first cusp of said pair of cylindrical bores.

32. The screw rotor device according to claim 31, wherein said leading face of said helical thread further comprises a leading edge, said leading face being in an eighth sealing relationship with said leading ridge, said leading edge being in a ninth sealing relationship with said leading side, and wherein said leading ridge and said leading edge are in a tenth sealing relationship with each other and with said second cusp of said pair of cylindrical bores.

33. The screw rotor device according to claim 32, wherein said female rotor and said male rotor further comprise a pair of ends in an eleventh sealing relationship and a twelfth sealing relationship with said first end and said second end of said housing, respectively.

34. The screw rotor device according to claim 32, wherein said leading edge and said trailing edge of said helical thread respectively define said leading side and said trailing side of said helical groove as said helical thread intermeshes with said helical groove.

35. The screw rotor device according to claim 32, wherein said leading ridge and said trailing ridge of said helical groove respectively define said leading face and said trailing face of said helical thread as said helical thread intermeshes with said helical groove.

36. The screw rotor device according to claim 32, wherein said leading edge and said trailing edge of said helical thread respectively define said leading side and said trailing side of said helical groove as said helical thread intermeshes with said helical groove, and wherein said leading ridge and said trailing ridge of said helical groove respectively define a leading root portion in said leading face and a trailing root portion in said trailing face of said helical thread.

37. The screw rotor device according to claim 31, wherein said sealing relationships each comprise a sealing tolerance defined by a geometric proximity between at least one of said female rotor and said male rotor, said female rotor and said housing, and said male rotor and said housing, and wherein said helical thread and said helical groove bound a space within said cylindrical bores, seal the working fluid within in said housing, and transition between meshing with each other and sealing around said housing while maintaining said sealing of the working fluid in said space.

38. The screw rotor device according to claim 37, wherein said top land of said helical thread separates said leading face from said trailing face by a minimum top land distance and wherein said minimum top land distance is at least an order of magnitude greater than said sealing tolerance between said helical thread and said helical groove.

39. The screw rotor device according to claim 37, wherein said sealing tolerance is no greater than at least one of an order of magnitude greater than said geometric proximity, 0.003" and $1/1{,}000$ of said male rotor diameter.

40. The screw rotor device according to claim 37, wherein said sealing tolerance is no greater than at least one of said geometric proximity, 0.001" and $1/10{,}000$ of said male rotor diameter.

41. The screw rotor device according to claim 37, wherein the positive displacement of the working fluid between said inlet port and said outlet port of said housing is produced by said female rotor and said male rotor with a thermodynamic efficiency of at least 85%.

42. The screw rotor device according to claim 37, wherein the positive displacement of the working fluid between said inlet port and said outlet port of said housing is produced by said female rotor and said male rotor with a thermodynamic efficiency of at least 90%.

43. The screw rotor device according to claim 37, wherein said helical thread intermeshes with said helical groove in a double sealing relationship wherein a leak pathway is not provided between said male rotor and said female rotor from said first side to said second side of said housing, wherein said leak pathway is a stream tube with an effective diameter greater than said minimum top land distance.

44. The screw rotor device according to claim 37, wherein said first sealing relationship comprises a first peripheral sealing area defined by geometries of said major diameter and said cylindrical bores, wherein said second sealing relationship comprises a center, non-meshing sealing area defined by geometries of said major diameter and said minor diameter, wherein said third sealing relationship comprises a second peripheral sealing area defined by geometries of said top land and said cylindrical bores, wherein said fourth sealing relationship comprises a center, intermeshing sealing area defined by geometries of said top land and said bottom land, wherein said fifth sealing relationship comprises an outer sealing line defined by geometries of said trailing face and said trailing ridge, wherein said sixth sealing relationship comprises an inner sealing line defined by geometries of said trailing edge and said trailing side, wherein said outer sealing line and said inner sealing line define boundaries of a first intermeshing sealing area between said trailing face and said trailing side and intersect at a common sealing point according to said seventh sealing relationship defined by intersection of trailing edge, trailing ridge and first cusp.

45. The screw rotor device according to claim 37, wherein said helical thread intermeshes with said helical groove in close proximity to said first cusp in a first triple sealing relationship wherein a blow hole is not provided between said helical thread, said helical groove and said first cusp.

46. The screw rotor device according to claim 45, wherein said helical thread intermeshes with said helical groove in close proximity to said second cusp in a second triple sealing relationship wherein a blow hole is not provided between said helical thread, said helical groove and said second cusp.

47. The screw rotor device according to claim 31, wherein said female rotor and said male rotor further comprise a plurality of grooves and threads, said plurality of grooves and threads being identical in number and intermeshing in phase with each other, wherein a cross-sectional profile of said male rotor comprises a tooth, an adjacent tooth, and a toothless sector between said tooth and said adjacent tooth, said tooth being subtended by a first arc angle and said sector comprising a second arc angle proportional to said first arc angle by a phase-offset multiplier, wherein said first sealing area and said third sealing area extend from said first side of said housing to said second side of said housing, and wherein the positive displacement of the working fluid between said inlet port and said outlet port of said housing is produced by said female rotor and said male rotor with a thermodynamic efficiency of at least 85%.

48. The screw rotor device according to claim 47, wherein said phase-offset multiplier is less than one.

49. The screw rotor device according to claim 47, wherein said phase-offset multiplier is at least one.

50. The screw rotor device according to claim 47, wherein said phase-offset multiplier is at least two.

51. The screw rotor device according to claim 47, wherein said phase-offset multiplier is at least three.

52. The screw rotor device according to claim 47, wherein said phase-offset multiplier is at least four.

53. The screw rotor device according to claim 47, further comprising a valve in communication with said outlet port, wherein said cross-sectional profile of said helical thread further comprises a leading root, a trailing root, a leading line extending from said first root to a leading edge point on said leading edge and a trailing line extending from said trailing root to a trailing edge point on said trailing edge, and wherein a cross-sectional profile of said helical groove further comprises a leading flank, a trailing flank, a complementary leading line extending from said leading flank to a leading ridge point on said leading ridge, and a complementary trailing line extending from said trailing flank to a trailing ridge point on said trailing ridge, and wherein the positive displacement of the working fluid between said inlet port and said outlet port of said housing is produced by said female rotor and said male rotor with a thermodynamic efficiency of at least 90%.

54. The screw rotor device according to claim 53, wherein said thread profile further comprises a leading edge discontinuity at said leading edge point where said leading line and said major diameter arc intersect and further comprises a trailing edge discontinuity at said trailing edge point where said trailing line and said major diameter arc intersect, and wherein said leading line, trailing line, leading complementary line and trailing complementary line are each selected from a group of lines consisting of straight lines, arcs, involutes, inverse-involutes, parabolas, hyperbolas, cycloids, trochoids, epicycloids, epitrochoids, hypocycloids, hypotrochoids, continuous straight lines and arcuate lines, and any combination thereof in piecewise-continuous lines.

55. The screw rotor device according to claim 53, wherein said leading edge point and said trailing edge point of said thread profile respectively define at least a portion of said complementary leading line and said complementary trailing line of said groove profile as said helical groove intermeshes with said helical thread, and wherein said leading ridge point and said trailing ridge point of said groove profile respectively define at least a portion of said leading line and said trailing line of said thread profile as said helical groove intermeshes with said helical thread.

56. The screw rotor device according to claim 55, wherein a non-defined portion of said leading line, said trailing line, said complementary leading line, said complementary trailing line is selected from a group of lines consisting of straight lines, arcs, involutes, inverse-involutes, parabolas, hyperbolas, cycloids, trochoids, epicycloids, epitrochoids, hypocycloids, hypotrochoids, continuous straight lines and arcuate lines, and any combination thereof in piecewise-continuous lines.

57. The screw rotor device according to claim 55, wherein said defined portions of said complementary leading line and said complementary trailing line are continuous arcuate lines extending from said leading ridge point and trailing ridge point to said leading flank and said trailing flank, respectively, and wherein said defined portions of said leading line and trailing line are continuous arcuate lines extending from said leading root and said trailing root to a leading intermediate point and a trailing intermediate point, respectively, said leading intermediate point being a point on said leading line between said leading root and said leading edge point and said trailing intermediate point being a point on said trailing line between said trailing root and said trailing edge point.

58. The screw rotor device according to claim 57, wherein said trailing line further comprises a trailing line segment from said trailing intermediate point to said trailing edge line and wherein said leading line further comprises a leading line segment from said leading intermediate point to said leading edge line, said trailing line segment and leading line segment being defined by points of proximity to said groove's complementary trailing line and complementary leading line, respectively.

59. The screw rotor device according to claim 31, wherein said outlet port is selected from the group of ports consisting of a circumferential end port, a V-shaped circumferential end port, a triangular side port, and any combination thereof and wherein said inlet port is selected from the groups of ports consisting of a circumferential end port, a W-shaped circumferential end port, a trapezoidal side port, and any combination thereof.

60. The screw rotor device according to claim 31, wherein a cross-sectional profile of said helical groove comprises a bottom land line situated between a pair of lines selected from a group consisting of a convex line, a straight line, a concave line, and any combination thereof, and wherein a cross-sectional profile of said helical thread comprises a top land line situated between a leading line and a trailing line, said leading line and said trailing line being selected from a group consisting of a concave line, a straight line, a convex line, and any combination thereof.

61. A screw rotor product for positive displacement of a working fluid, comprising:

a housing comprising an inlet port at a first end and an outlet port at a second end and a pair of cylindrical bores extending therebetween, said pair of cylindrical bores comprising a front cusp extending along a length of a front side of said housing and a back cusp extending along a length of a back side of said housing;

a female rotor comprising a major diameter and a plurality of helical grooves receding from said major diameter to a bottom land diameter, wherein said female rotor is rotatably mounted within said first end and said second end of said housing and wherein said major diameter is in close tolerance with said housing; and a male rotor comprising a minor diameter and a plurality of helical threads extending from said minor diameter to a top land diameter, wherein said male rotor is rotatably mounted within said housing and counter-rotates with respect to said female rotor, wherein said top land diameter is in close tolerance with said housing, wherein said plurality of threads are identical in number with said plurality of grooves and intermesh in phase with each other in a plurality of thread-groove pairs, each of said thread-groove pairs defining an intermeshing sealing area extending continuously from a back intersection defined by said female rotor major diameter and said top land diameter simultaneously in close tolerance with said back cusp to a front intersection defined by said female rotor major diameter and said top land diameter simultaneously in close tolerance with said front cusp, and wherein said thread-groove pairs bound a plurality of non-communicating spaces within said cylindrical bores, seal the working fluid within said housing, and transition between meshing with each other and sealing around said housing while maintaining said sealing of the working fluid in said non-communicating spaces.

62. The screw rotor device according to claim 61, wherein each one of said plurality of non-communicating spaces are comprised of a plurality of contiguous boundary areas comprising said intermeshing sealing area coterminous with at least one non-meshing sealing area.

63. The screw rotor device according to claim 62, wherein said intermeshing sealing area is further comprised of a front sealing region and a back sealing region, said front sealing region and said back sealing region each extending continuously from said male rotor minor diameter and said female rotor major diameter to said top land diameter and said bottom land diameter, respectively, and wherein said non-meshing sealing area extends from said one of said thread-groove pairs to an adjacent thread-groove pair, said non-meshing sealing area being formed between said major diameter of said female rotor rotating in close tolerance to said minor diameter of said male rotor.

64. The screw rotor device according to claim 63, wherein said intermeshing sealing area is respectively comprised of a leading face and a leading side in said one of said thread-groove pair and a trailing face and a trailing side in said adjacent thread-groove pair.

65. The screw rotor device according to claim 64, wherein at least one of said transition, said non-meshing sealing area, and said intermeshing sealing area further comprises a small gap within an order of magnitude of said close tolerance.

66. The screw rotor device according to claim 64, wherein at least one of said transition, said non-meshing sealing area, and said intermeshing sealing area further comprises a small gap approximately equal to said close tolerance.

67. The screw rotor device according to claim 64, wherein said helical thread and said helical groove intermesh at said inlet port and close off said spaces from said inlet to seal the working fluid in said housing.

68. The screw rotor device according to claim 61, wherein a cross-sectional profile of said male rotor further comprises a tooth, an adjacent tooth and a toothless sector therebetween, said tooth being subtended by a first arc angle and said toothless sector comprising a second arc angle that is at least twice said first arc angle, wherein said tooth is asymmetric with reference to said first arc angle.

69. The screw rotor device according to claim 68, wherein said toothless sector comprises a second arc angle that is at least thrice said first arc angle.

70. The screw rotor device according to claim 69, wherein said toothless sector comprises a second arc angle that is at least quadruple said first arc angle.

71. The screw rotor device according to claim 61, wherein said helical threads and said helical grooves are comprised of variable-pitch helical threads and variable-pitch helical grooves, respectively, wherein said pitch varies axially with said length of said housing.

72. The screw rotor device according to claim 61, wherein the positive displacement of the working fluid between said inlet port and said outlet port of said housing is produced by said female rotor and said male rotor with a thermodynamic efficiency of at least 85%.

73. The screw rotor device according to claim 61, further comprising a recirculation path for the working fluid from said outlet port to said inlet port and external to the positive displacement of the working fluid between said inlet port and said outlet port within said housing.

74. The screw rotor device according to claim 61, further comprising at least one of another male rotor and another female rotor intermeshing in phase with at least one of said female rotor and said male rotor, respectively.

75. The screw rotor device according to claim 61, further comprising a plurality of screw rotor pairs, wherein each screw rotor pair comprises at least one male rotor and at least one female rotor, and wherein said screw rotor pairs are in fluid communication with each other.

76. The screw rotor device according to claim 75, wherein said screw rotor pairs are a set of positive displacement machines selected from the group consisting of a compressor to compressor set, a compressor to expander set, an expander to compressor set, and an expander to expander set.

77. The screw rotor device according to claim 76, wherein said set of positive displacement machines comprise said male rotor and said female rotor and at least one additional rotor pair, said additional rotor pair comprising an additional male rotor and an additional female rotor selected from the group consisting of a pair of in-phase intermeshing rotors, a pair of offset-thread rotors, a pair of in-phase intermeshing, offset-thread rotors, a pair of Roots-type rotors, a pair of Krigar-type rotors, a pair of Lysholm-type rotors, a pair of scroll rotors, and any equivalent rotor pair.

78. The screw rotor device according to claim 77, further comprising at least one of another male rotor and another female rotor, wherein said another male rotor intermeshes in phase with at least one of said female rotor and said additional female rotor and wherein said another female rotor intermeshes in phase with at least one of said male rotor and said additional male rotor.

79. The screw rotor device according to claim 76, wherein said housing encloses each one of said screw rotor pairs in said set of positive displacement machines.

80. The screw rotor device according to claim 76, further comprising an additional housing enclosing at least one of said screw rotor pairs in said set of positive displacement machines and comprising a fluid conduit for the working fluid between said plurality of screw rotor pairs.

81. The screw rotor device according to claim 80, wherein said fluid conduit further comprises a thermodynamic processor selected from the group consisting of an intercooler, a heat exchanger, a burner section, a bypass section, and any combination thereof.

82. The screw rotor device according to claim 75, wherein said screw rotor pairs further comprise a female rotor shaft for said female rotor and a male rotor shaft for said male rotor.

83. The screw rotor device according to claim 82, wherein said female rotor shaft is unique to said female rotor in each of said screw rotor pairs and wherein said male rotor shaft is unique to said male rotor in each of said screw rotor pairs.

84. The screw rotor device according to claim 82, wherein at least one of said female rotor shaft and said male rotor shaft is a shared shaft selected from the group consisting of a male to male shaft, a male to female shaft, a female to male shaft, and a female to female shaft.

85. The screw rotor device according to claim 75, further comprising at least one of a drive shaft, a power-input shaft, a fluid conduit, a compressed air source, a nozzle, a valve, a fuel inlet, a wheel, and a thermodynamic processor, wherein at least one of said plurality of screw rotor pairs are in at least one of fluid communication and mechanical communication with said drive shaft, said power-input shaft, said fluid conduit, said compressed air source, said nozzle, said valve, said wheel, said fuel inlet, and said thermodynamic processor.

86. The screw rotor device according to claim 85, wherein said plurality of screw rotor pairs are arranged in said at least one fluid communication and mechanical communication with at least one of said drive shaft, said power-input shaft, said fluid conduit, said compressed air source, said nozzle, said valve, said fuel inlet, said wheel, and said thermodynamic processor in a positive displacement machine configuration selected from the group consisting of a compressor, an expander, a motor, a pump, a hydrostatic drive, a hydraulic motor, a shop equipment motor, a positive-drive motor, a hydraulic pump, an internal combustion engine, an axial flow jet engine, and any equivalent rotary piston application.

87. The screw rotor device according to claim 61, further comprising at least one of a drive shaft, a power-input shaft, a fluid conduit, a compressed air source, a nozzle, a valve, a fuel inlet, a wheel, and a thermodynamic processor, wherein at least one of said male rotor and said female rotor is in at least one of fluid communication and mechanical communication with said drive shaft, said power-input shaft, said fluid conduit, said compressed air source, said nozzle, said valve, said fuel inlet, said wheel, and said thermodynamic processor, and wherein a cross-sectional profile of said male rotor further comprises a tooth, an adjacent tooth and a toothless sector therebetween, said tooth being subtended by a first arc angle and said toothless sector comprising a second arc angle that is at least twice said first arc angle.

88. The screw rotor device according to claim 87, wherein said female rotor and said male rotor are arranged in said at least one fluid communication and mechanical communication with at least one of said drive shaft, said power-input shaft, said fluid conduit, said compressed air source, said nozzle, said valve, said fuel inlet, said wheel, and said thermodynamic processor in a positive displacement machine configuration selected from the group consisting of a compressor, an expander, a motor, a pump, a hydrostatic drive, a hydraulic motor, a positive-drive motor, a hydraulic pump, an internal combustion engine, an axial flow jet engine, and any equivalent rotary piston application.

89. The screw rotor device according to claim 61, further comprising:

a pressurized driving fluid source;

a fluid conduit in fluid communication between said pressurized driving fluid source and said inlet;

a drive shaft in mechanical communication with at least one of said male rotor and said female rotor; and at least one of a tool holder, a blade and a wheel operatively connected to said drive shaft.

90. The screw rotor device according to claim 89, wherein at least one of a front blow hole and a back blow hole is not provided between said helical thread, said helical groove, said front cusp, and said back cusp, wherein said pressurized driving fluid source is selected from the group of a compressed air source and a pressurized water source, and wherein said drive shaft is connected to at least one of said blade of a hydrodynamic garbage crusher, said blade of a hydrodynamic watering lawn mower, said tool holder of a milling machine, and said wheel of a hydrostatic drive vehicle.

91. The screw rotor device according to claim 61, wherein at least one of a front blow hole and a back blow hole is not provided between said helical thread, said helical groove, said front cusp, and said back cusp, and wherein said compressed air source is comprised of an additional rotor pair selected from the group consisting of a pair of in-phase intermeshing rotors, a pair of offset-thread rotors, a pair of in-phase intermeshing, offset-thread rotors, a pair of Roots-type rotors, a pair of Krigar-type rotors, a pair of Lysholm-type rotors, a pair of scroll rotors, and any equivalent rotor pair.

92. The screw rotor device according to claim 91, further comprising:

at least one additional rotor pair, said additional rotor pair comprising an additional inlet, an additional outlet, an additional male rotor and an additional female rotor;

a fluid conduit in fluid communication with and between said outlet and said additional inlet; and at least one thermodynamic processor in fluid communication with at least one of said outlet, said additional rotor pair, and said fluid conduit.

93. The screw rotor device according to claim 92, wherein said at least one rotor pair is a pair of in-phase intermeshing, offset-thread rotors selected from the group consisting of a compressor and an expander, wherein said male rotor is further comprised of a male rotor shaft and wherein said female rotor is comprised of a female rotor shaft, and wherein at least one of said female rotor shaft and said male rotor shaft is a shared shaft with at least one of said additional male rotor and said additional female rotor.

94. The screw rotor device according to claim 91, further comprising:

a burner in fluid communication with said outlet;

an expander in fluid communication with said burner; and a nozzle in fluid communication with said expander.

95. The screw rotor device according to claim 94, further comprising at least one additional rotor pair selected from the group consisting of a compressor and an expander.

96. The screw rotor device according to claim 91, further comprising:

a fuel inlet in fluid communication with at least one of said non-communicating spaces within said cylindrical bores; and a valve in communication with at least one of said outlet port and said fuel inlet.

97. The screw rotor device according to claim 96, further comprising at least one additional rotor pair, said additional rotor pair comprising an additional inlet, an additional outlet, an additional male rotor and an additional female rotor, wherein said male rotor is further comprised of a male rotor shaft and wherein said female rotor is comprised of a female rotor shaft, and wherein at least one of said female rotor shaft and said male rotor shaft is a shared shaft with at least one of said additional male rotor and said additional female rotor.

98. The screw rotor device according to claim 96, wherein said helical thread and said helical groove each comprise multiple pitches in said length of said housing.

99. A screw rotor product for positive displacement of a working fluid, comprising:

a housing comprising an inlet port, an outlet port, and a pair of cylindrical bores, said pair of cylindrical bores comprising a front cusp extending along a length of a front side of said housing and a back cusp extending along a length of a back side of said housing;

a female rotor comprising at least one helical groove receding from a ridge at a major diameter to a bottom land, wherein said female rotor is rotatably mounted within said housing; and a male rotor comprising at least one helical thread extending from a root at a minor diameter to a top land, wherein said male rotor is rotatably mounted within said housing and counter-rotates with respect to said female rotor, wherein said helical thread intermeshes in phase with said helical groove and defines an intermeshing sealing area extending continuously between said helical thread and said helical groove from said back cusp to said front cusp, wherein at least one of a front blow hole and a back blow hole is not provided between said helical thread, said helical groove, said front cusp, and said back cusp, and wherein said major diameter of said female rotor and said minor diameter of said male rotor define a non-intermeshing sealing area extending between said male rotor and said female rotor from a seal at said ridge and said root.

100. The screw rotor product according to claim 99, wherein said helical thread and said helical groove each comprise multiple pitches in said length of said housing and wherein said non-intermeshing sealing area extends between adjacent intermeshing sealing areas, from said ridge and said root to an adjacent ridge and an adjacent root.

101. The screw rotor device according to claim 99, further comprising:

a pressurized driving fluid source;

a fluid conduit in fluid communication between said driving fluid source and said inlet;

a drive shaft in mechanical communication with at least one of said male rotor and said female rotor; and at least one of a tool holder, a blade and a wheel operatively connected to said drive shaft.

102. The screw rotor device according to claim 101 wherein said pressurized driving fluid source is selected from the group of a compressed air source and a pressurized water source.

103. The screw rotor device according to claim 102 wherein said drive shaft is connected to at least one of said blade of a hydrodynamic garbage crusher, said blade of a hydrodynamic watering lawn mower, and said tool holder of a milling machine.

104. The screw rotor device according to claim 99, further comprising at least one of a drive shaft, a power-input shaft, a fluid conduit, a compressed air source, a nozzle, a valve, a fuel inlet, a wheel, and a thermodynamic processor, wherein said female rotor and said male rotor are arranged in at least one of a fluid communication and a mechanical communication with at least one of said drive shaft, said power-input shaft, said fluid conduit, said compressed air source, said nozzle, said valve, said fuel inlet, and said thermodynamic processor in a positive displacement machine configuration selected from the group consisting of a compressor, an expander, a motor, a pump, a hydrostatic drive, a hydraulic motor, a positive-drive motor, a hydraulic pump, an internal combustion engine, an axial flowjet engine, and any equivalent rotary piston application, and wherein a cross-sectional profile of said male rotor further comprises a tooth, an adjacent tooth and a toothless sector therebetween, said tooth being subtended by a first arc angle and said toothless sector comprising a second arc angle that is at least twice said first arc angle.

* * * * *